US012550985B2

(12) United States Patent
Nevin

(10) Patent No.: US 12,550,985 B2
(45) Date of Patent: Feb. 17, 2026

(54) PIVOTING CANTILEVER UMBRELLA, UMBRELLA MITIGATING THE RISKS OF WIND DAMAGE, AND ANGLE BRACKET FOR A CANTILEVER UMBRELLA

(71) Applicant: Michael Patrick Nevin, Constantia (ZA)

(72) Inventor: Michael Patrick Nevin, Constantia (ZA)

( * ) Notice: Subject to any disclaimer, the term of this patent is extended or adjusted under 35 U.S.C. 154(b) by 104 days.

(21) Appl. No.: 18/011,232

(22) PCT Filed: Jun. 25, 2021

(86) PCT No.: PCT/IB2021/055679

§ 371 (c)(1),
(2) Date: Dec. 19, 2022

(87) PCT Pub. No.: WO2022/003514

PCT Pub. Date: Jan. 6, 2022

(65) Prior Publication Data

US 2023/0232946 A1 Jul. 27, 2023

(30) Foreign Application Priority Data

| | | |
|---|---|---|
| Jun. 29, 2020 | (ZA) | 2020/03929 |
| Jun. 30, 2020 | (ZA) | 2020/03960 |
| Jan. 20, 2021 | (ZA) | 2021/00412 |

(51) Int. Cl.

| | |
|---|---|
| ***A45B 23/00*** | (2006.01) |
| ***A45B 17/00*** | (2006.01) |
| ***A45B 25/02*** | (2006.01) |

(52) U.S. Cl.

CPC ..... *A45B 17/00* (2013.01); *A45B 23/00* (2013.01); *A45B 25/02* (2013.01); *A45B 2023/0012* (2013.01); *A45B 2023/005* (2013.01)

(58) Field of Classification Search

CPC ..... A45B 2023/0037; A45B 2023/005; A45B 2023/0081; A45B 2023/0087

See application file for complete search history.

(56) References Cited

U.S. PATENT DOCUMENTS 3,726,295 A * 4/1973 Diaz ..... A45B 19/00 135/25.31
6,412,506 B1 * 7/2002 Reese ..... E04H 12/2238 135/21

(Continued)

FOREIGN PATENT DOCUMENTS

WO WO 2020/106694 5/2020

OTHER PUBLICATIONS

International Search Report and the Written Opinion Dated Nov. 24, 2021 From the International Searching Authority Re. Application No. PCT/I821/55679. (11 Pages).

(Continued)

*Primary Examiner* — Noah Chandler Hawk

(57) ABSTRACT

An cantilever umbrella (100) comprises a base (102), post (101), cantilever arm (103) and a canopy (106) that is supported on a hub (104) with radial arms (105). The canopy (106) can pivot about an axis parallel to the cantilever arm (103) by pivoting the hub (104) relative to the cantilever arm. The umbrella (100) is protected against excess wind by pivoting outer parts (202) of the radial arms (105) upwards, but holding the outer parts (202) down with tension in the canopy (106) during normal use. A concealed, self-aligning angle bracket (300) is used to attach an upper end (302) of the post (101) to a proximal end (303) of the cantilever arm (103).

11 Claims, 25 Drawing Sheets

(56) References Cited

U.S. PATENT DOCUMENTS

| | | | | |
|---|---|---|---|---|
| 7,134,442 | B2 * | 11/2006 | Ma | A45B 25/14 135/20.1 |
| 9,237,785 | B2 | 1/2016 | Ma | |
| 9,629,428 | B1 | 4/2017 | Nei | |
| 9,930,942 | B2 * | 4/2018 | Ma | A45B 23/00 |
| 10,426,234 | B1 | 10/2019 | Volin | |
| 11,612,224 | B2 * | 3/2023 | Luo | A45B 25/02 135/96 |
| 12,127,645 | B2 * | 10/2024 | Luo | A45B 17/00 |
| 2004/0177871 | A1 | 9/2004 | Harbaugh | |
| 2006/0278262 | A1 * | 12/2006 | Ma | A45B 23/00 135/20.1 |
| 2014/0158173 | A1 | 6/2014 | Li et al. | |
| 2014/0230867 | A1 | 8/2014 | Ma | |
| 2015/0059815 | A1 | 3/2015 | Xiong | |
| 2018/0153269 | A1 | 6/2018 | Ma | |
| 2023/0292891 | A1 * | 9/2023 | Luo | A45B 25/02 |

OTHER PUBLICATIONS

Patents Act 1977: Examination Report Under Section 18(3) Dated Nov. 27, 2023 From the Intellectual Property Office of the United Kingdom of Great Britain Re. Application No. GB2301255.2. (4 Pages).

* cited by examiner

PIVOTING CANTILEVER UMBRELLA, UMBRELLA MITIGATING THE RISKS OF WIND DAMAGE, AND ANGLE BRACKET FOR A CANTILEVER UMBRELLA

RELATED APPLICATIONS

This application is a National Phase of PCT Patent Application No PCT/IB2021/055679 having International filing date of Jun. 25, 2021, which claims the benefit of priority of South African Patent Applications Nos. 2020/03929 filed on Jun. 29, 2020, 2020/03960 filed on Jun. 30, 2020, and 2021/00412 filed on Jan. 20, 2021. The contents of the above applications are all incorporated by reference as if fully set forth herein in their entirety.

FIELD AND BACKGROUND OF THE INVENTION

This invention relates to umbrellas such as garden or patio umbrellas and in particular to radially opening cantilever umbrellas. However, while the invention is described and illustrated with reference to radially opening cantilever umbrellas, several features of the umbrellas can be used also in other umbrellas.

There is often a need to pivot the canopy of an umbrella to optimise the shading it provides. Several mechanisms for such tilting actions have been devised—of which the most common is a pivoting action along the post of an umbrella. However, these mechanisms are cumbersome to operate and/or unreliable.

Umbrellas are often exposed to strong winds, such as unexpected gusts or weather conditions that changed while an umbrella is unattended. Strong winds can damage an umbrella, e.g. by tearing its canopy or bending or breaking parts of it, but can also cause loss of or damage to property or and/or cause injury, e.g. when an umbrella is blown over or lands after becoming airborne.

A cantilever or side-post umbrella has an upright post to the side of the umbrella canopy and a cantilever arm (or horizontal post) that extends horizontally from the vertical post, to support the canopy. The post and cantilever arm need to bear the weight of the canopy, as well as wind loads exerted on the canopy and the cantilever arm serves as a moment arm so that substantial forces and moments in different directions need to be borne by the connection between the post and the cantilever arm. Currently existing connections between posts and cantilever arms that are strong enough to bear all these loads are unsightly and/or expensive to produce.

The present invention seeks to provide an umbrella with a canopy that can be tilted easily and reliably. The invention also seeks to provide an umbrella that can mitigate the risks associated with exposure of umbrellas to strong wind. The invention further seeks to provide a connection between an upright post and cantilever arm with sufficient strength, in a manner that is aesthetically pleasing, cost effective and easy to install.

SUMMARY OF THE INVENTION

According to a first aspect of the present invention there is provided an umbrella comprising:

a hub;

a plurality of radial arms extending from the hub;

a canopy supported on top of the radial arms;

an upright post;

a cantilever arm extending from the post to the hub;

wherein the cantilever arm is aligned with a part of the canopy and the hub is pivotally attached to the cantilever arm, to pivot about a pivot axis that is aligned with the cantilever arm.

The term "upright" is not limited to vertical or near-vertical orientations and includes also steeply slanted or raked orientations.

The umbrella may be a radially opening umbrella and at least some of the radial arms may be pivotally attached to the hub to pivoting about upright axes along a conical plane of the canopy.

The umbrella may include a latch mechanism that is displaceable between a free condition in which the hub is free to pivot about the pivot axis, and a latch condition in which the hub is held against pivoting about the pivot axis.

The latch mechanism may include a latch pin that is supported on the cantilever arm and that is displaceable parallel to the pivot axis, to engage the hub.

The latch mechanism may include a bar that is supported on the cantilever arm and that is displaceable along the cantilever arm to operate the latch mechanism between the free condition and the latch condition, and the bar may be manually operable from the proximity of the post.

An end of the bar that faces towards the post may be displaceable between a free position in which the bar can move longitudinally along the cantilever arm, and a lock position in which the bar is held against longitudinal movement along the cantilever arm.

According to another aspect of the present invention there is provided an umbrella comprising:

a hub;

a plurality of radial arms extending radially outwards from the hub in a domed configuration, each of the radial arms having a distal end that is radially remote from the hub; and a canopy supported in a domed configuration on top of the radial arms and that is attached to at least some of the radial arms in the vicinity of the distal ends of the radial arms, there being at least some tension in the canopy between the distal ends of at least some of the radial arms;

wherein at least some of the radial arms each comprises an inner part that is attached to the hub and an outer part that is pivotally attached to the inner part by a hinge mechanism, the hinge mechanism being configured to pivot the outer part between an un-activated position in which the outer part is aligned with the domed configuration of the canopy, and an activated position in which the distal end of the radial arm is pivoted towards the hub;

wherein each of the hinge mechanisms includes at least one stop formation that prevents the outer part of the radial arm from pivoting from its un-activated position in a direction away from its activated position; and wherein the tension in the canopy between distal ends of the radial arms resists pivoting motion of the outer parts of the radial arms towards their activated position, when they are in their un-activated positions.

The terms "dome" and "domed" are used broadly herein and includes rounded domes, cones and any like shapes that protrude towards an apex.

Each hinge mechanism may include at least one inner stop formation that is attached to the inner part of the radial arm and at least one outer stop formation that is attached to the outer part of the radial arm, the inner stop formation and outer stop formation being held in abutment by the tension in the canopy, when the outer part of the radial arm is in its un-activated position.

According to a further aspect of the present invention there is provided an umbrella comprising:

an upright post with a hollow upper end that defines an internal post cavity at least at the upper end;

a canopy;

a cantilever arm extending between the post and the canopy to support the canopy, the cantilever arm having a hollow proximal end that is attached to the upper end of the post and the cantilever arm defining an internal arm cavity at least at the proximal end; and a bracket with a horizontal protuberance that is receivable in the arm cavity, a vertically expanding sub-assembly that is supported on the horizontal protuberance and that is configured to be expanded to grip an inside of the arm cavity, a vertical protuberance that is receivable in the post cavity, and a horizontally expanding sub-assembly that is supported on the vertical protuberance and that is configured to be expanded to grip an inside of the post cavity.

The horizontally expanding sub-assembly may include a pressure element that is loosely supported by the vertical protuberance to pivot between a receiving orientation and a grip orientation, the pressure element defining a grip face and being configured to pivot under gravity to the receiving orientation when the bracket is in an upright orientation at least partly outside the arm cavity, the grip face protruding from the vertical protuberance when the pressure element is in the receiving orientation and being disposed to engage with the inside of the post cavity and to pivot the pressure element to the grip orientation when the vertical protuberance is inserted into the post cavity, the grip face being aligned with the inside of the post cavity when the pressure element is in the grip orientation.

BRIEF DESCRIPTION OF THE SEVERAL VIEWS OF THE DRAWINGS

For a better understanding of the present invention, and to show how it may be put into effect, the invention will now be described by way of non-limiting example, with reference to the accompanying drawings in which.

DESCRIPTION OF SPECIFIC EMBODIMENTS OF THE INVENTION

Figure 1:
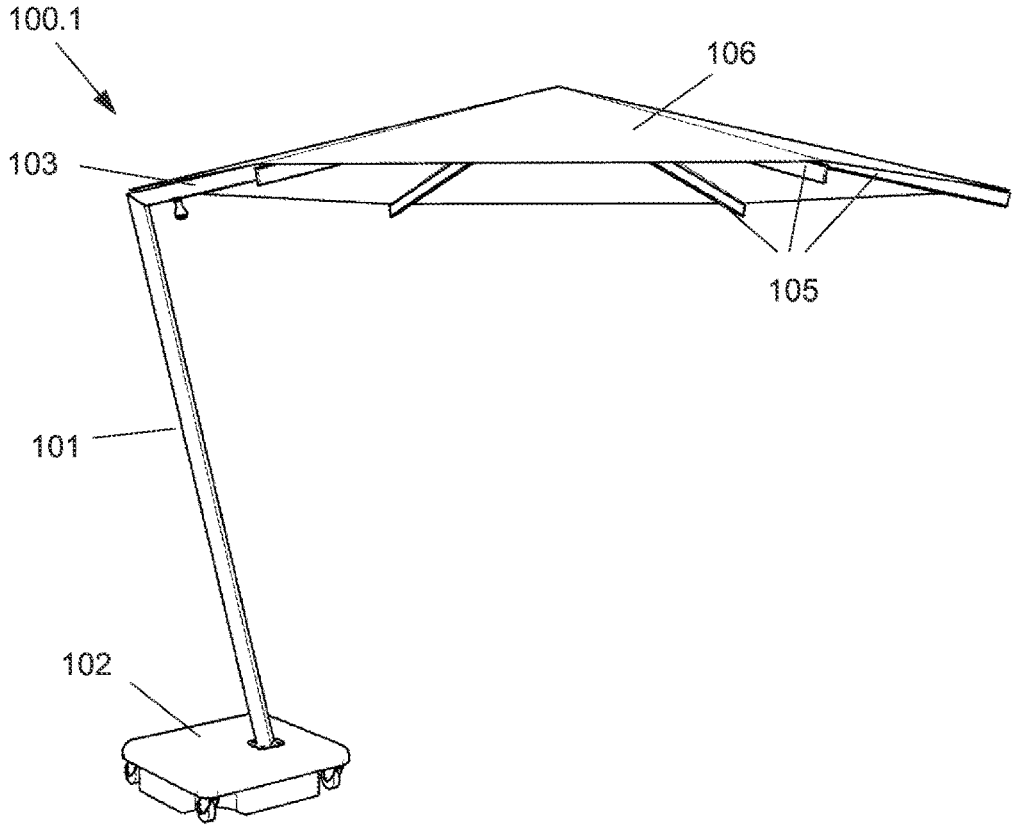
FIG. 1 is a three-dimensional view of a first embodiment of an umbrella according to the present invention.
Figure 2:
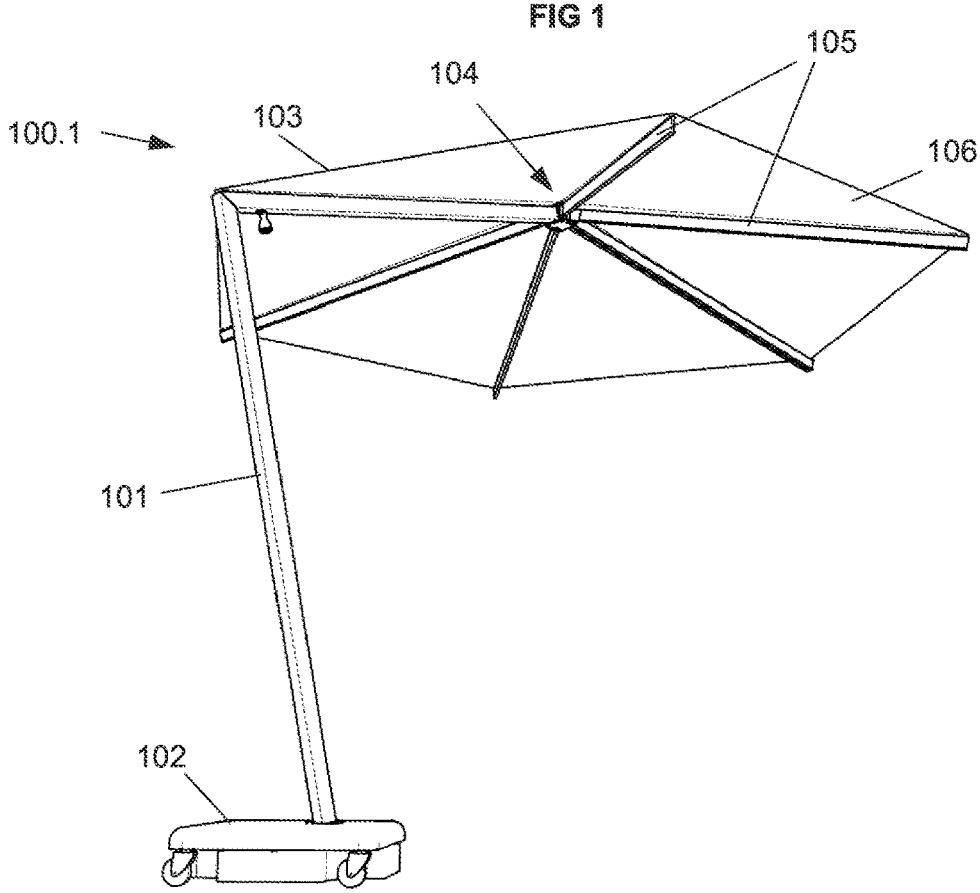
FIG. 2 is a three-dimensional view of the umbrella of FIG. 1, from below.
Figure 3:
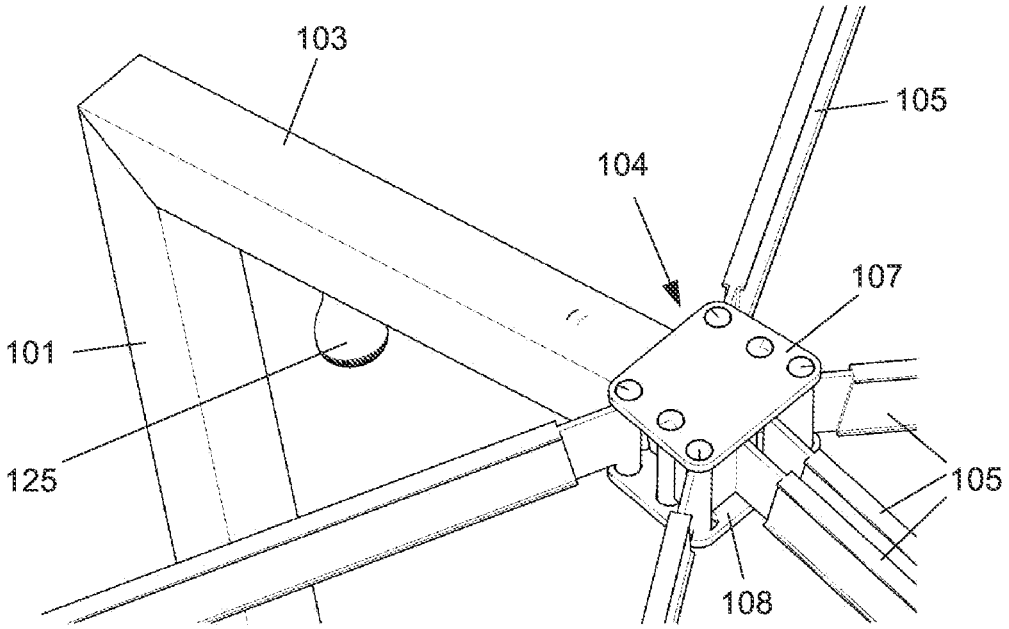
FIG. 3 is a top three-dimensional view of the cantilever arm and hub of the umbrella of FIG. 1, with its canopy omitted.
Figure 4:
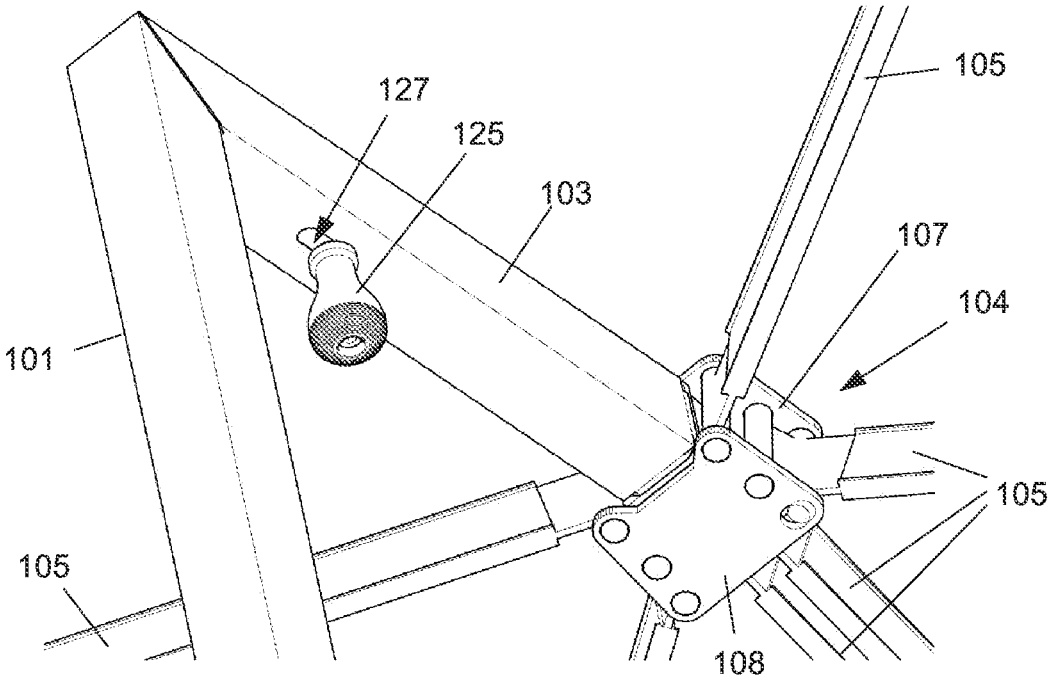
FIG. 4 is a bottom three-dimensional view of the cantilever arm and hub of the umbrella of FIG. 1.
Figure 5:
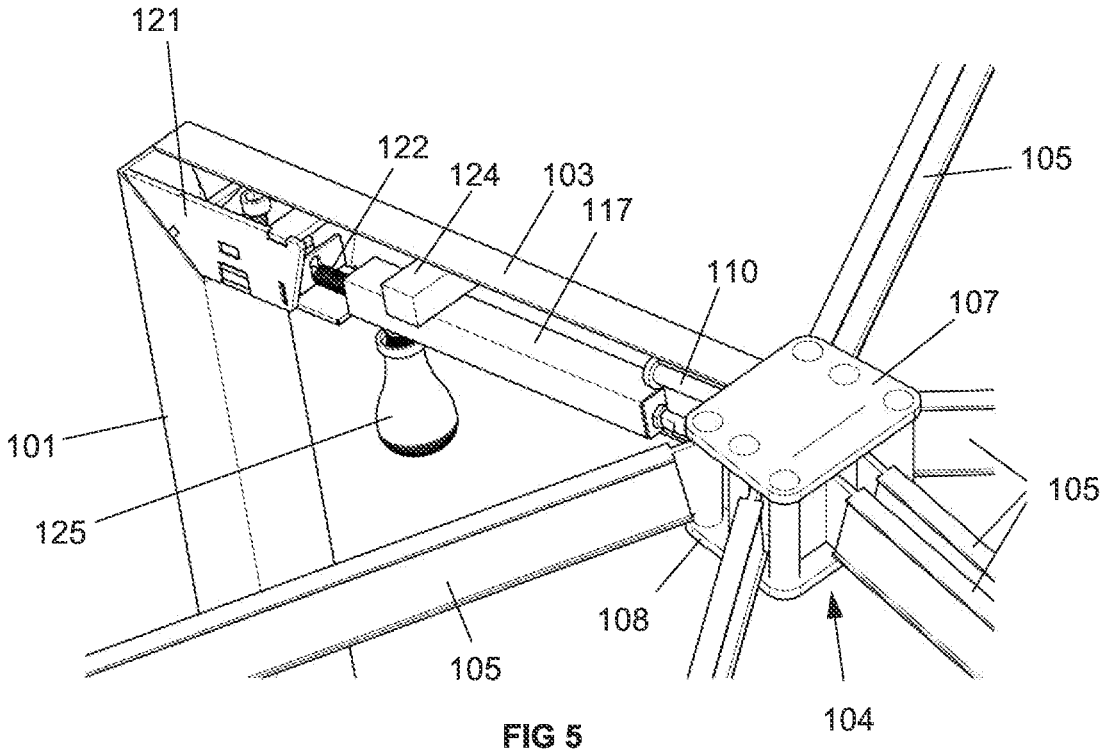
FIG. 5 is a top three-dimensional cutaway view of the cantilever arm and hub of FIG. 4, with half of the cantilever arm's outer shell omitted to show parts of the internal latch mechanism.
Figure 6:
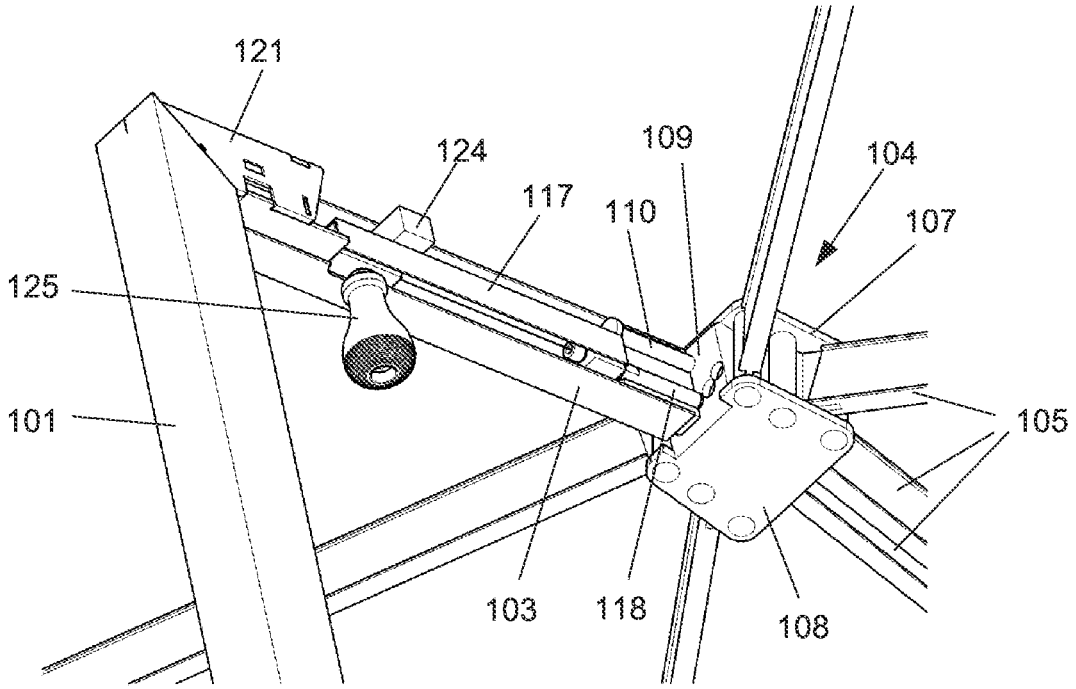
FIG. 6 is a bottom three-dimensional cutaway view of the cantilever arm and hub of FIG. 5.

Referring to the drawings, an umbrella according to the present invention is identified, generally, by reference sign 100, but each embodiment of the umbrella is identified by a suffix. Features that are common to different embodiments of the invention, are identified by the same reference signs Referring to FIGS. 1 to 22, a first embodiment of an umbrella 100.1 according to the present invention is a side post or cantilever umbrella with a generally upright post 101 that is supported on a base 102. In the illustrated embodiment, the base 102 is mobile and the post 101 is raked, but in other embodiments, the post can be upright and can be supported by other means, e.g. by fixed attachment to an adjacent structure.

A cantilever arm 103 extends from the post 101 to a hub 104 of the umbrella and radial arms 105 extend from the hub. In the illustrated embodiment, the radial arms 105 are pivotally supported by the hub and they can each pivot about upright pivot axes along a conical plane between stowed and deployed positions, so the umbrella 100.1 is a radially opening umbrella. Radial opening is a preferred feature of the umbrella 100.1, but is it not essential to the present invention.

A canopy 106 of sheet material, preferably fabric, is supported on top of the cantilever arm 103, hub 104 and radial arms 105. However, it is essential that the cantilever arm 103 is thus generally aligned with the canopy 106 and is preferably in the same plane as the canopy.

In the illustrated embodiment, the cantilever arm 103 is attached to the top of the post 101 at a right angle and both the post and cantilever arm are made of hollow square tubing. This configuration has advantages of aesthetics and weight distribution, among others, but it is not essential to the present invention.

The hub 104 includes a top plate 107 and a bottom plate 108, to which the radial arms 105 are pivotally attached and the top and bottom plates are held in a spaced apart configuration by a central structure of the hub that includes a pivot plate 109, adjacent the free end of the cantilever arm 103. A pivot pin 110 with a pivot axis 111 extends radially outwardly from the pivot plate, preferably at a slightly downward angle that resembles a slightly downward angle by which the radial arms 105 extend from the hub 104. Five locating holes 112 are defined in the pivot plate 109 and are circumferentially spaced about the pivot pin 110. Other embodiments of the invention could have different numbers of locating holes.

At the free or distal end of the cantilever arm 103—i.e. the end that is furthest from the post 101, a pivot block 113 is provided inside the cantilever arm and two passages in are defined in the pivot block in the form of a pivot hole 114 and latch hole 115 that are each parallel to the cantilever arm. The pivot pin 110 of the hub 104 extends through the pivot hole 114 and serves as a pivotal axle so that the hub 104 and thus also the radial arms 105 and canopy 106 can pivot about the pivot axis 111 that is common between the pivot pin and the pivot hole. The spacing between the pivot hole 114 and latch hole 115 is the same as the radial spacing between the pivot axis 111 and the locating holes 112, so that the latch hole can line up with the locating holes, in turn, depending on the orientation of the hub 104 about the pivot axis.

A latch mechanism 116 is provided inside the cantilever arm 103 and comprises a bar 117 that is displaceable inside the cantilever arm. The bar 117 serves several purposes, as will be described below and it can have different physical shapes, but in the illustrated embodiment, the bar has a U-shaped profile into which fixing elements have been attached at its opposing ends.

At the end of the bar 117 facing the hub 104, a latch pin 118 extends generally longitudinally from the bar, but the latch pin is attached to the bar with some play, so that the latch pin can pivot slightly relative to the bar. The latch pin 118 is received inside the latch hole 115 in which it can slide axially so that its free end can engage one of the locating holes 112 on the hub 104 if the hub is tilted so that the latch pin and the particular locating hole are aligned. The free end of the latch pin 118 is tapered to assist it in entering a locating hole, even in the event of slight misalignment.

In a preferred embodiment, the free end of the latch pin 118 is tapered with a sharp conical shape (with a vertex angle of less than 90 degrees, e.g. with a vertex angle of 60 degrees). This serves to provide a mechanical lock that prevents the latch pin from being wedged out of the locating hole 112 if the hub 104 moved, e.g. by wind acting on the canopy 106. The tapered shape of the latch pin 118 also makes it easier to withdraw from the locating hole 112, because if the latch pin were cylindrical, it would be extremely difficult to withdraw from the locating hole if lateral forces where present that would jam the latch pin in the locating hole. The tapered shape of the free end of the latch pin 118 reduces its contact surface when it is inserted into the locating hole 112 or locates on the perimeter of the hole—which is preferably chamfered with a larger vertex angle than the vertex angle of the latch pin, e.g. the perimeter of locating hole may have a chamfer angle of 45 degrees and a vertex angle of 90 degrees, so that the tapered part of the latch pin 118 seats on the edge between the chamfer and the cylindrical inner part of the locating hole. The use of a tapered end on the latch pin 118—especially if seating in a chamfered locating hole 112 with a larger vertex angle, ensures alignment and solid engagement of the latch pin in the locating hole, without "play" (which could result in rattling) and without having to manufacture these components to high tolerances.

At the end of the bar 117 facing the post 101, a spring pin 119 extends longitudinally from the bar 117 and passes through a vertical slot 120 that is defined in an internal angle bracket 121. The angle bracket 121 is used to attach the cantilever arm 103 to the post 101 and is described in more detail below. A compression spring 122 is fitted around the spring pin 119 and presses against the end of the bar 117 and against the angle bracket adjacent the slot 120. The spring 122 thus urges the bar 117 away from the angle bracket 121 and towards the hub 104 and is used to urge the latch pin 118 to engage one of the locating holes 112, when it is aligned with a locating hole.

The angle bracket 121 has a protruding lip 123 that extends below the spring pin 118 and the end of the bar 117 that is closest to the post 101 is vertically displaceable inside the cantilever arm 103 so that it can be displaced between a locked position, in which a lower edge of the bar is horizontally aligned with the lip, and an unlocked position in which the lower edge of the bar is higher than the lip. Incorporating the lip 123 as part of the angle bracket 121 is a convenient, but other suitable formations could be used instead, to serve the purpose of the lip 123, e.g. a fixed plate or stopper can be provided that is unrelated to the angle bracket. As the bar 117 is displaced between its locked and unlocked positions, the spring pin 122 slides up and down inside the slot 120 in the angle bracket 121. Further, the movement of the bar 117 inside the cantilever arm 103 is guided by a guide block 124 that is fitted above the bar, with sufficient play between the guide block and the top wall of the cantilever arm 103, to allow movement of the bar between its locked and unlocked positions.

A knob 125 is attached to the bar 117 near its end facing the post 101, by a shank 126 that extends downwards from the bar and passes through a longitudinal slot 127 in the underside of the cantilever arm 103—with the knob fitted on the shank, below the cantilever arm. The knob 125 is provided with a compression spring 128 that presses against a shoulder or washer 129, which presses against the underside of the cantilever arm 103, on the outside of the slot 127. The spring 128 thus urges the knob downwards from the underside of the cantilever arm 103 and thus urges the end of the bar 117 facing the post 101, downwards.

Figure 7:
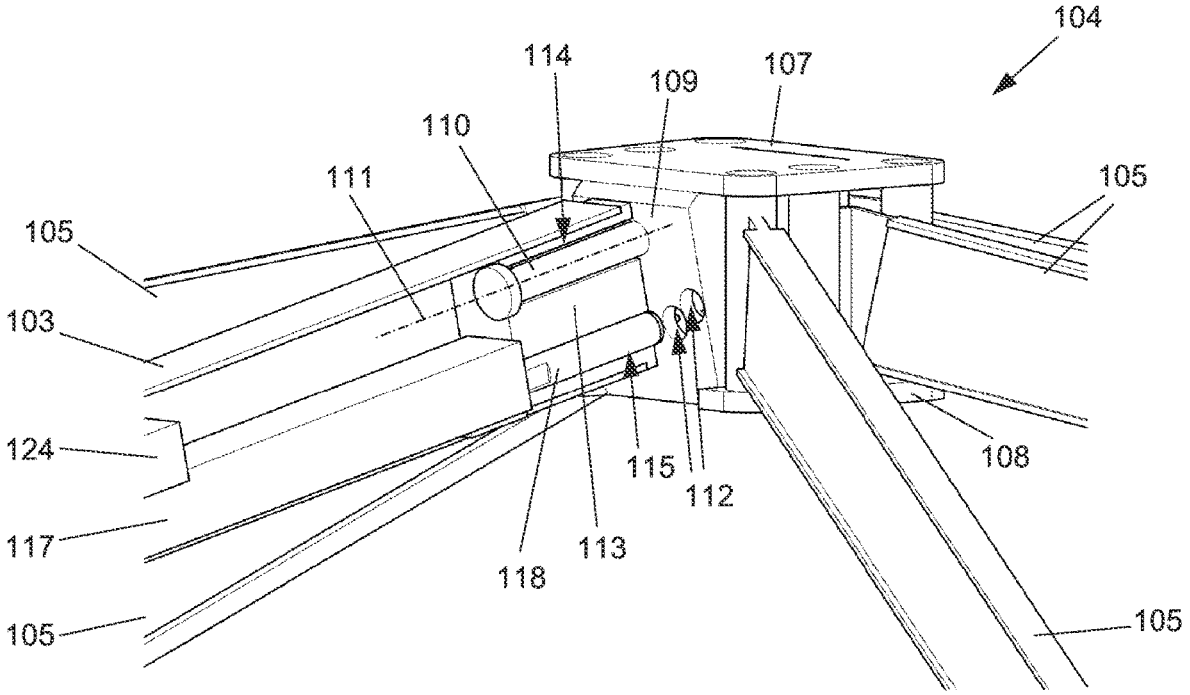
FIG. 7 is a detail three-dimensional cutaway view of part of a latch mechanism of the umbrella of FIG. 1, at the hub, while the umbrella's canopy is in a horizontal position and the latch mechanism is engaged and locked.
Figure 8:
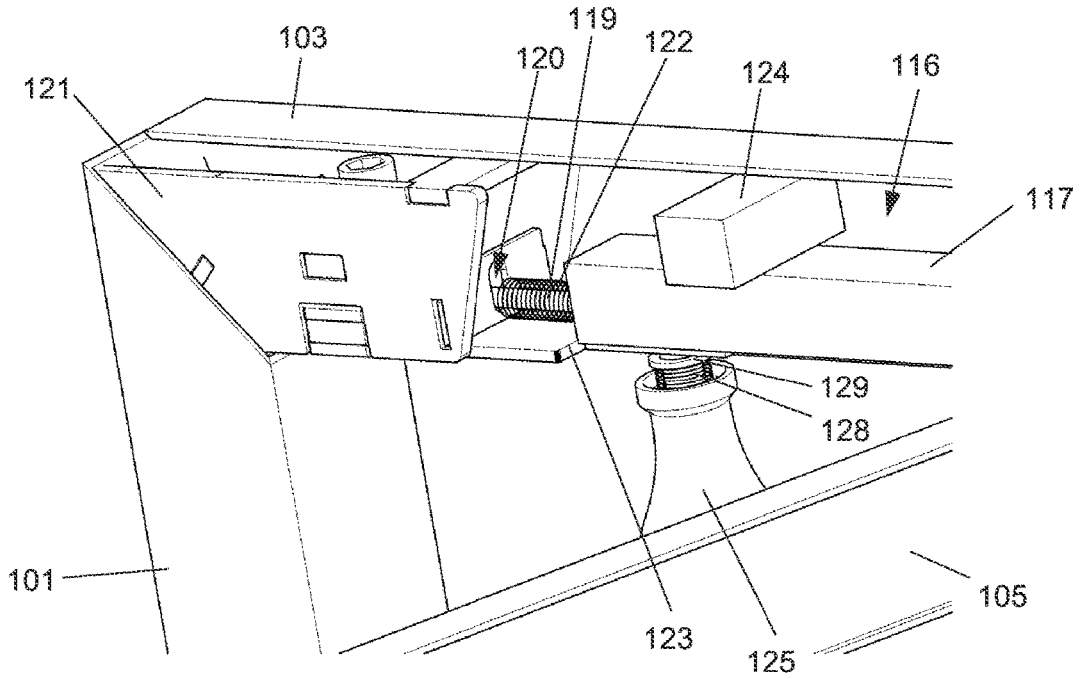
FIG. 8 is a detail three-dimensional cutaway view of a manually operable part of the latch mechanism of the umbrella of FIG. 7.

FIGS. 7 and 8 show the latch mechanism 116 in an engaged and locked condition. It is engaged, because the latch pin 118 is engaged with one of the locating holes 112 and it is locked because the end of the bar 117 facing the post 101 is in its locked position, in which a lower edge of the bar is horizontally aligned with the lip 123 and the lip prevents the bar from sliding away from the hub 104—and thus prevents the latch pin 118 from disengaging. The spring 128 pushes the knob 125 downwards and thus holds the bar 117 in its locked position.

Figure 9:
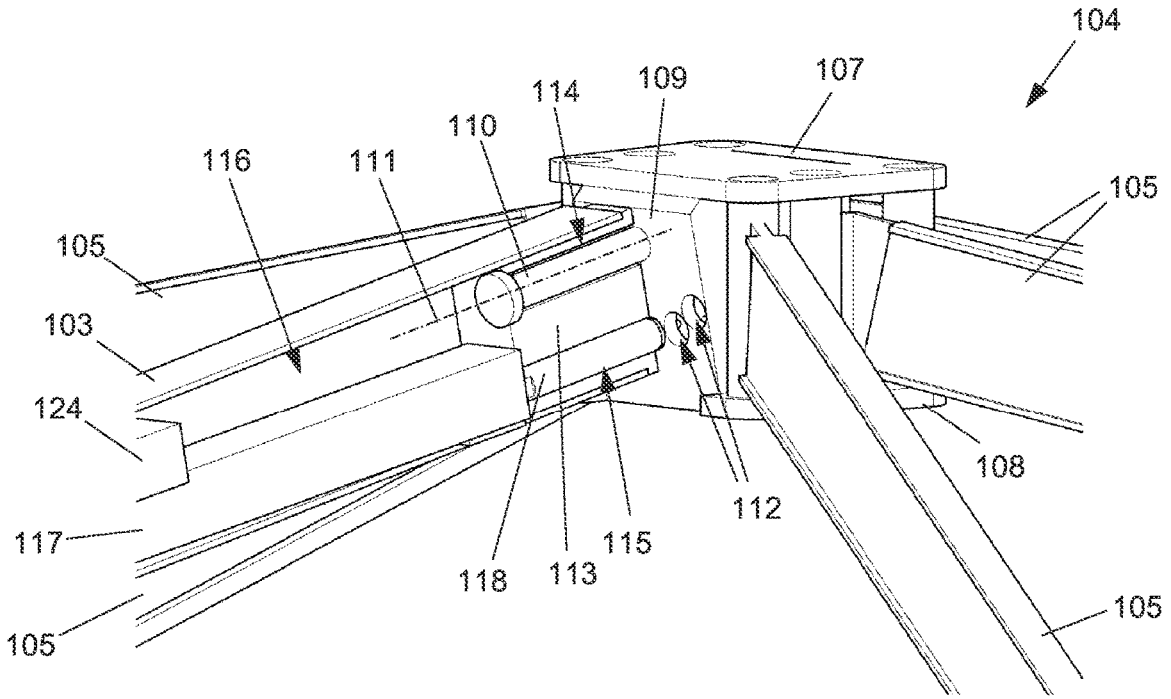
FIG. 9 is a detail three-dimensional cutaway view of the latch mechanism of FIG. 7 with the canopy in a horizontal position, with the latch mechanism engaged, but unlocked.
Figure 10:
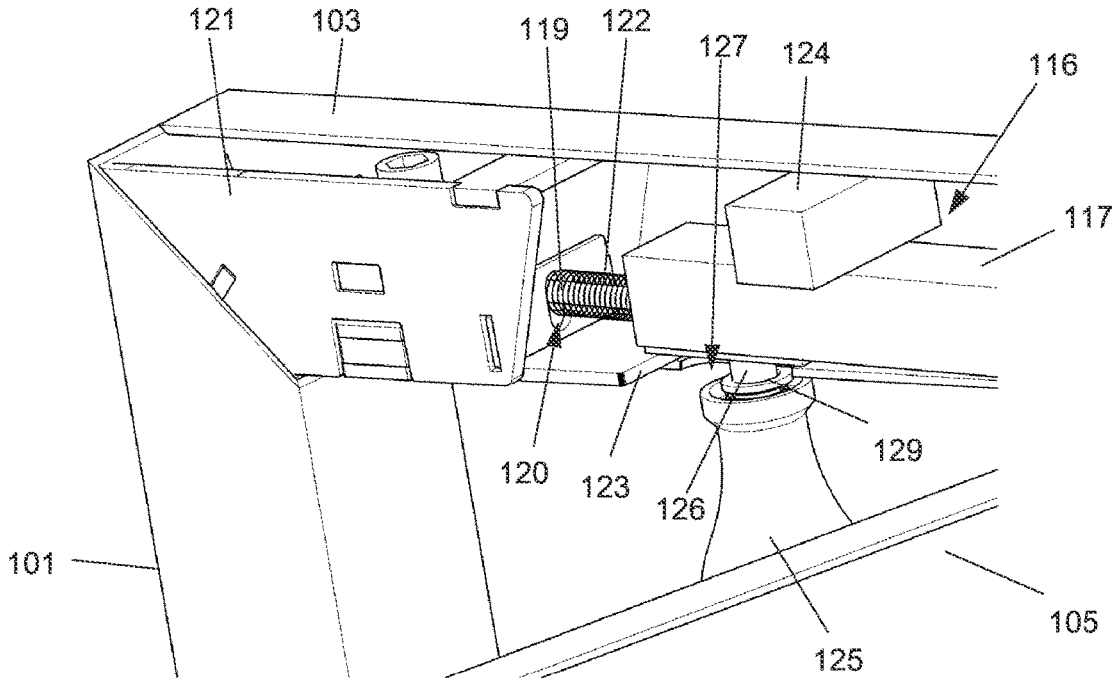
FIG. 10 is a detail three-dimensional cutaway view of the manually operable part of the latch mechanism of the umbrella of FIG. 9.

FIGS. 9 and 10 show the latch mechanism 116 in an engaged, but unlocked condition. The latch pin 118 is still engaged with one of the locating holes 112, but the knob 125 has been pressed upwards manually against the bias of the spring 128 so that the lower edge of the bar 117 is above the lip 123 and the lip thus no longer locks the bar against sliding away from the hub. Only the end of the bar 117 that faces the post 101 is lifted by the knob 125, so that the bar is no longer parallel to the cantilever arm 103, but the latch pin 118 is still parallel to the cantilever arm, because it is held inside the latch hole 115 and this slight misalignment between the latch pin 118 and the bar 117 is tolerated by the play with which the latch pin is attached to the bar.

Figure 11:
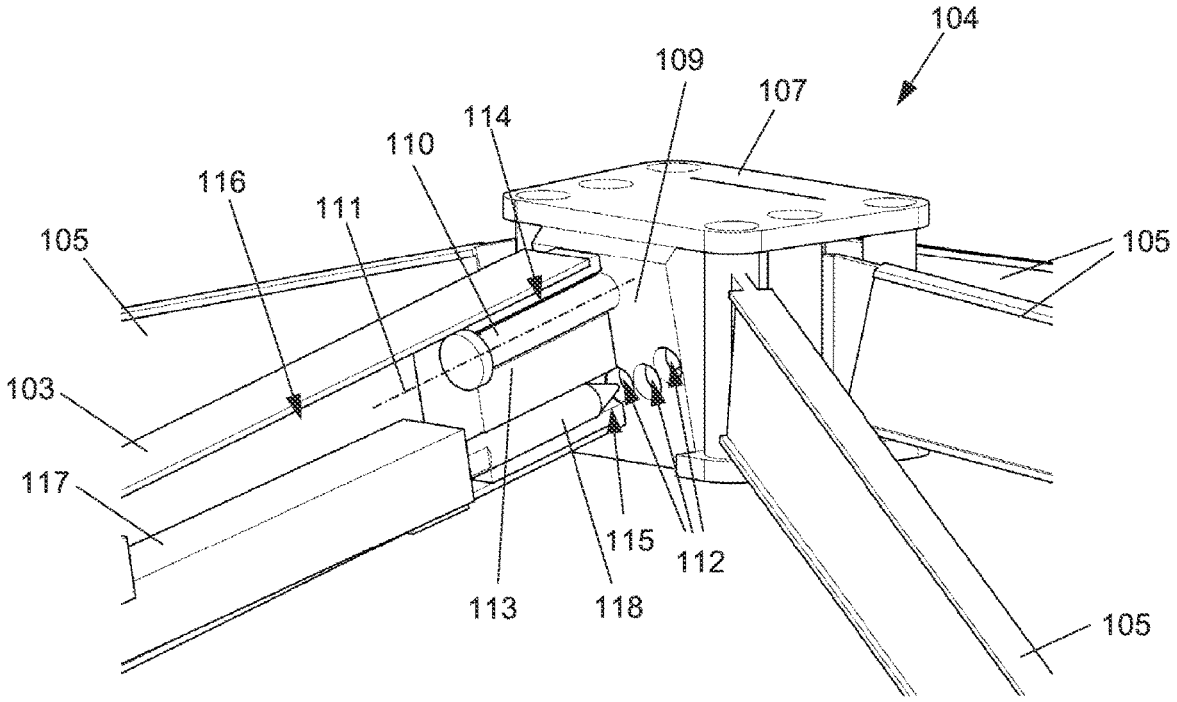
FIG. 11 is a detail three-dimensional cutaway view of the latch mechanism of FIG. 7 with the canopy in a horizontal position, with the latch mechanism disengaged and unlocked.
Figure 12:
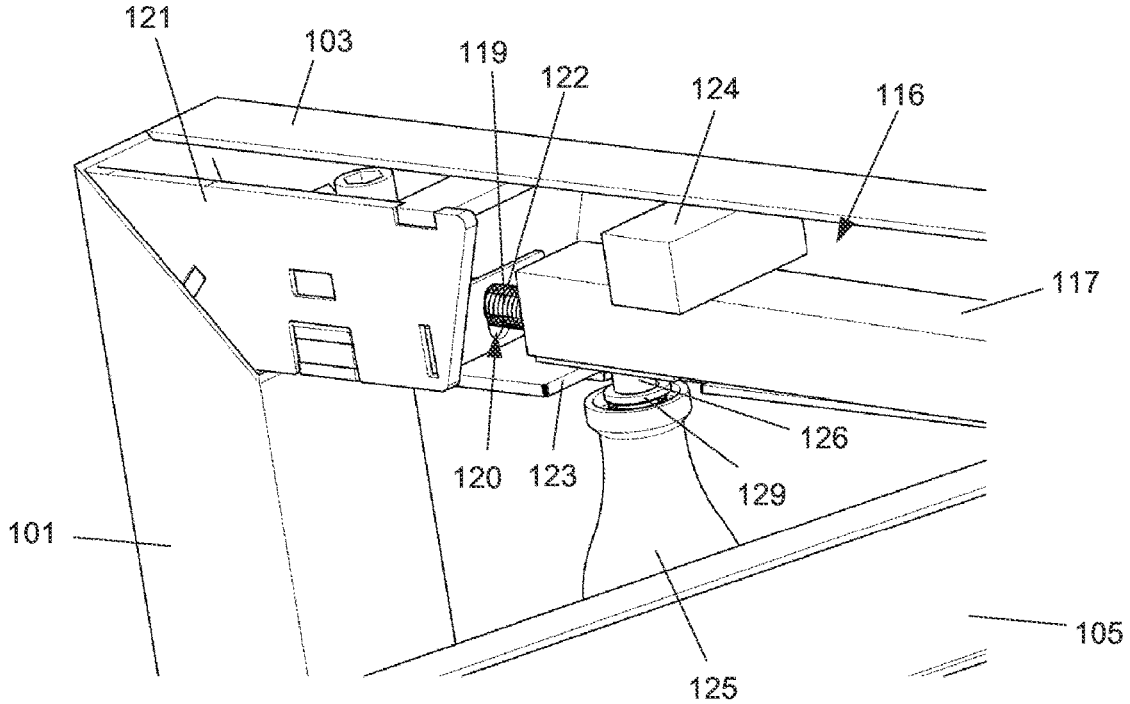
FIG. 12 is a detail three-dimensional cutaway view of the manually operable part of the latch mechanism of the umbrella of FIG. 11.

FIGS. 11 and 12 show the latch mechanism 116 in a disengaged and unlocked condition in which the knob has been pushed manually to slide the bar 117 away from the hub 104, against the bias of the spring 122, to withdraw the latch pin 118 from the locating hole 112. The disengagement of the latch pin 118 from the locating hole 112 frees the hub 104 and thus the canopy 106 to pivot about the pivot axis 111. The tapered shape of the free end of the latch pin 118 and its engagement with the perimeter of the locating hole 112 allows easy withdrawal of the latch pin from the locating hole—as described above.

If the canopy 106 and hub 104 are pivoted to a position in which one of the locating holes 112 is again aligned with the latch pin 118, the spring 122 will urge the bar 117 and the latch pin towards the hub, so that the latch pin will engage the locating hole and once the bar has been slid towards the hub 104, the spring 128 will urge the end of the bar downwards, to its locked position. The engagement and locking of the latch mechanism 116 thus occurs automatically without any manual intervention, as soon as the canopy 106 is tilted to a position in which the latch pin 118 is aligned with one of the locating holes 112.

The latch mechanism 116 shown in the drawings and described above, is preferred, but the invention can also be used with other mechanisms that allow the hub 104 to tilt selectively relative to the cantilever arm 103 about the pivot axis 111. Other examples include a locking and releasing mechanism that in which a latch is pivoted, rather than slid longitudinally, to engage and disengage the hub, a self-locking gear set (such as a worm gear), etc.

Figure 13:
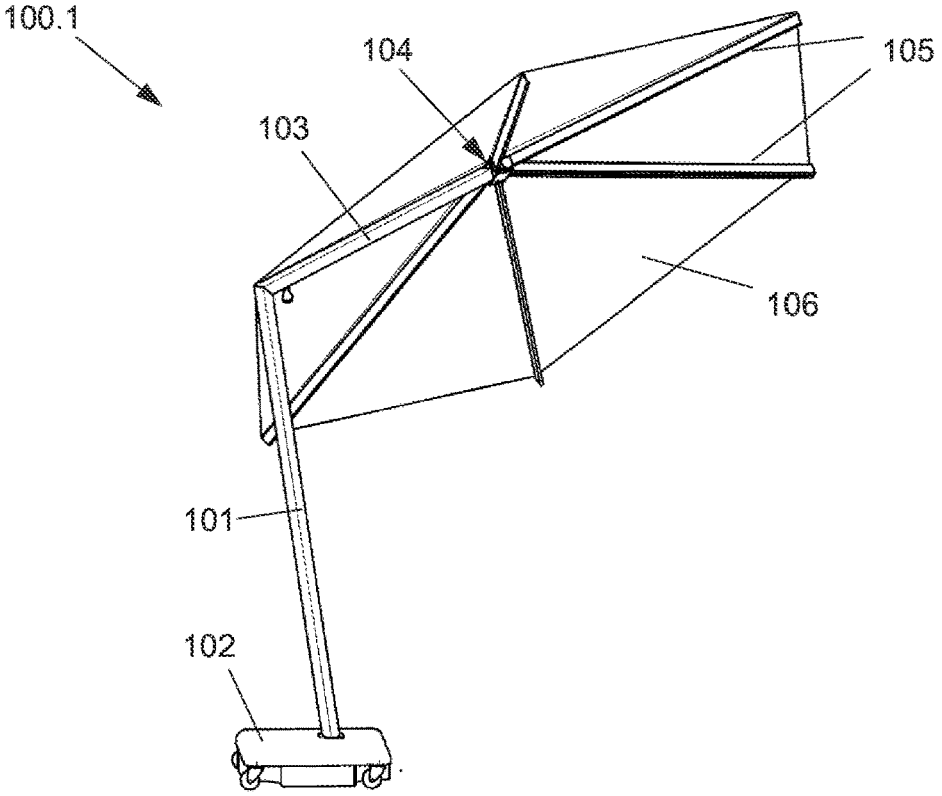
FIG. 13 is a three-dimensional view of the umbrella of FIG. 1 with its canopy fully pivoted left.
Figure 14:
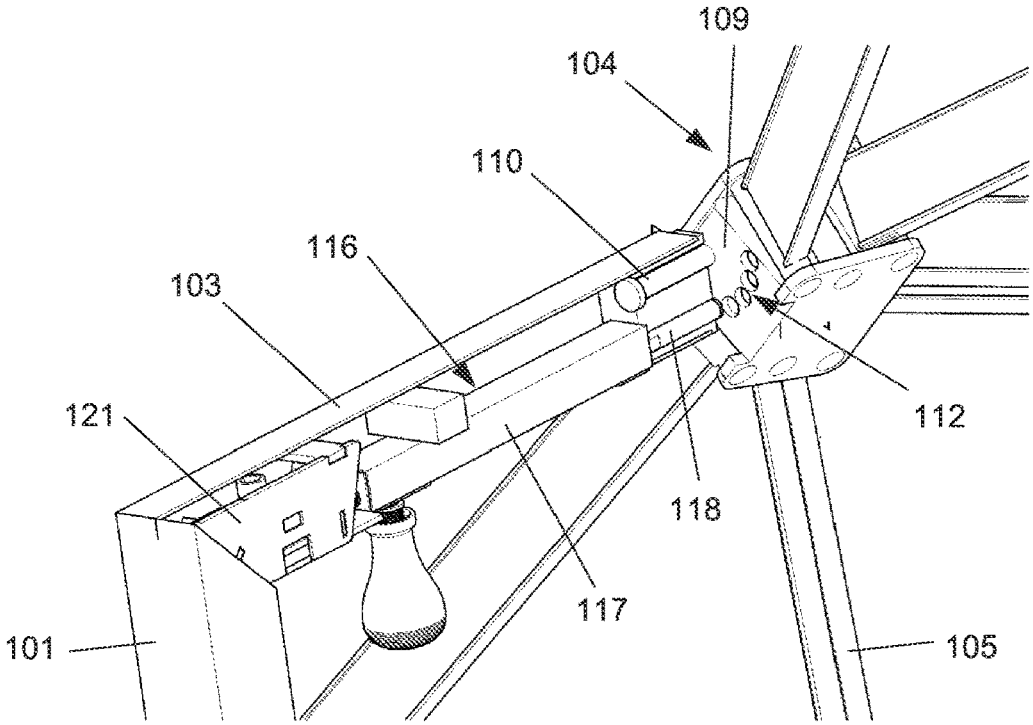
FIG. 14 is a three-dimensional view of the latch mechanism of the umbrella of FIG. 13.
Figure 15:
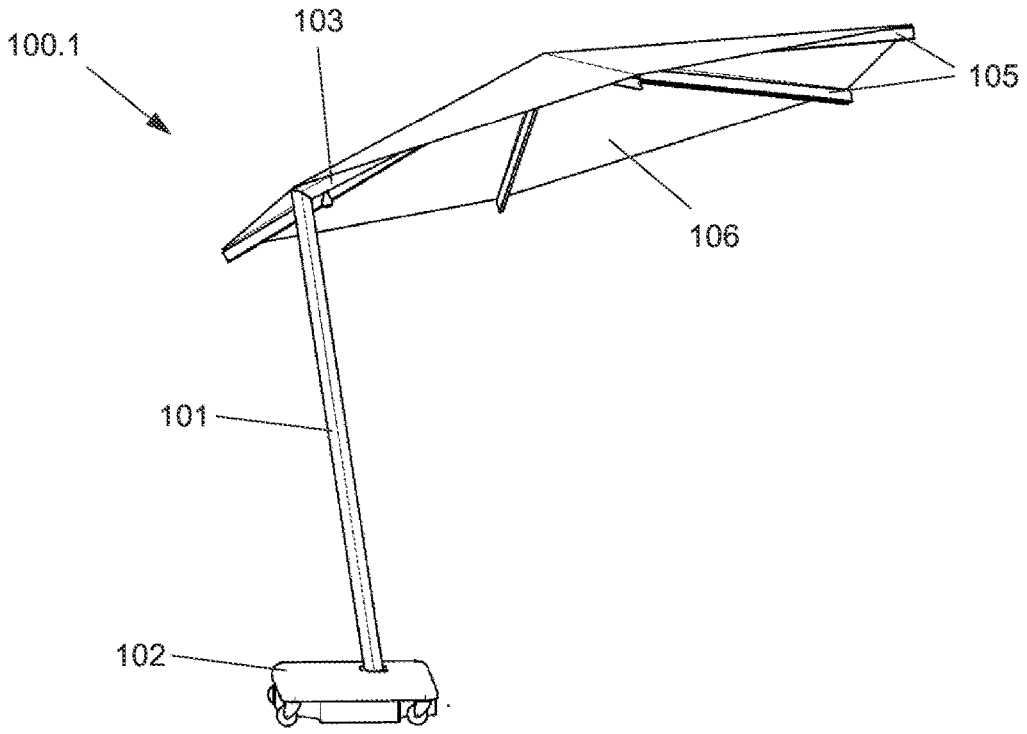
FIG. 15 is a three-dimensional view of the umbrella of FIG. 1 with its canopy partly pivoted left.
Figure 16:
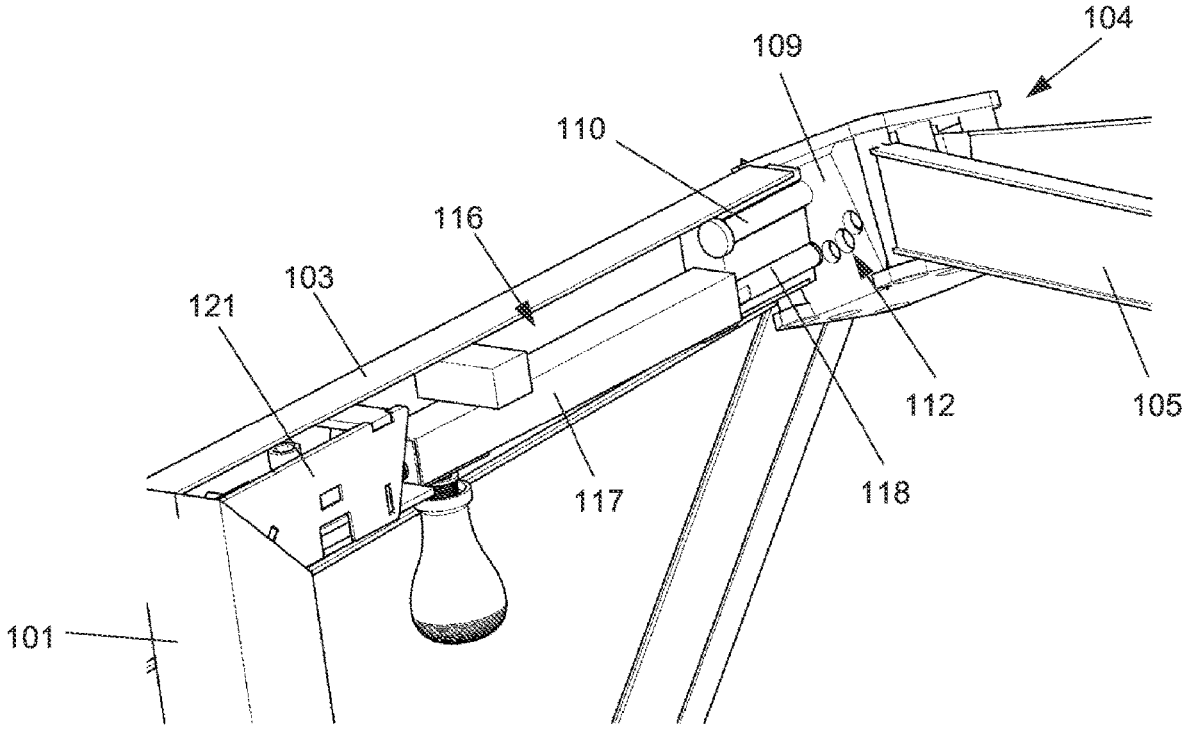
FIG. 16 is a three-dimensional view of the latch mechanism of the umbrella of FIG. 15.
Figure 17:
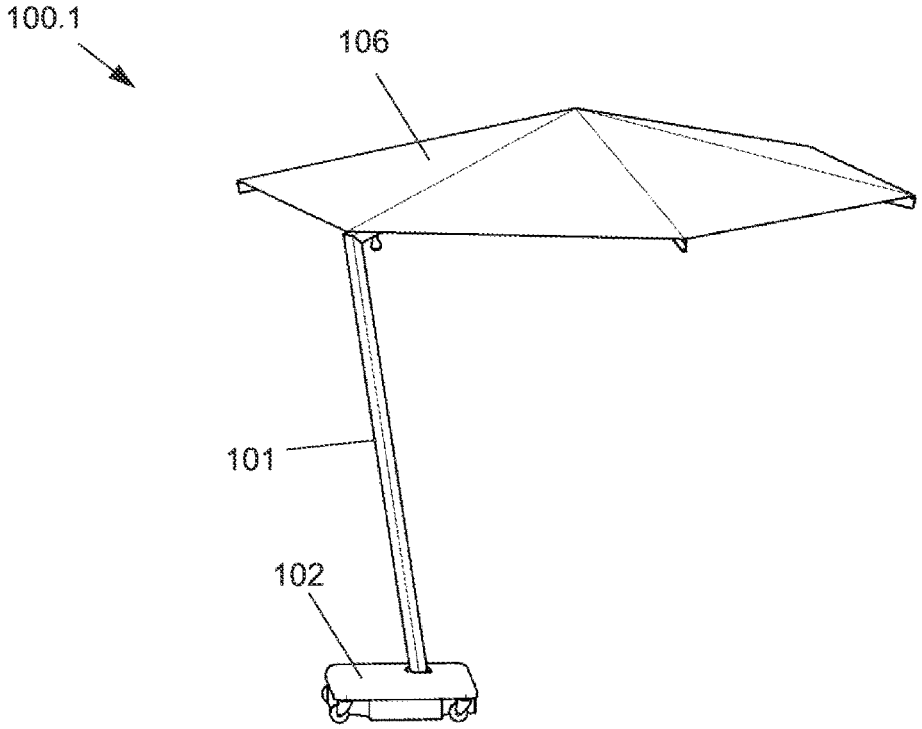
FIG. 17 is a three-dimensional view of the umbrella of FIG. 1 with its canopy in the horizontal position.
Figure 18:
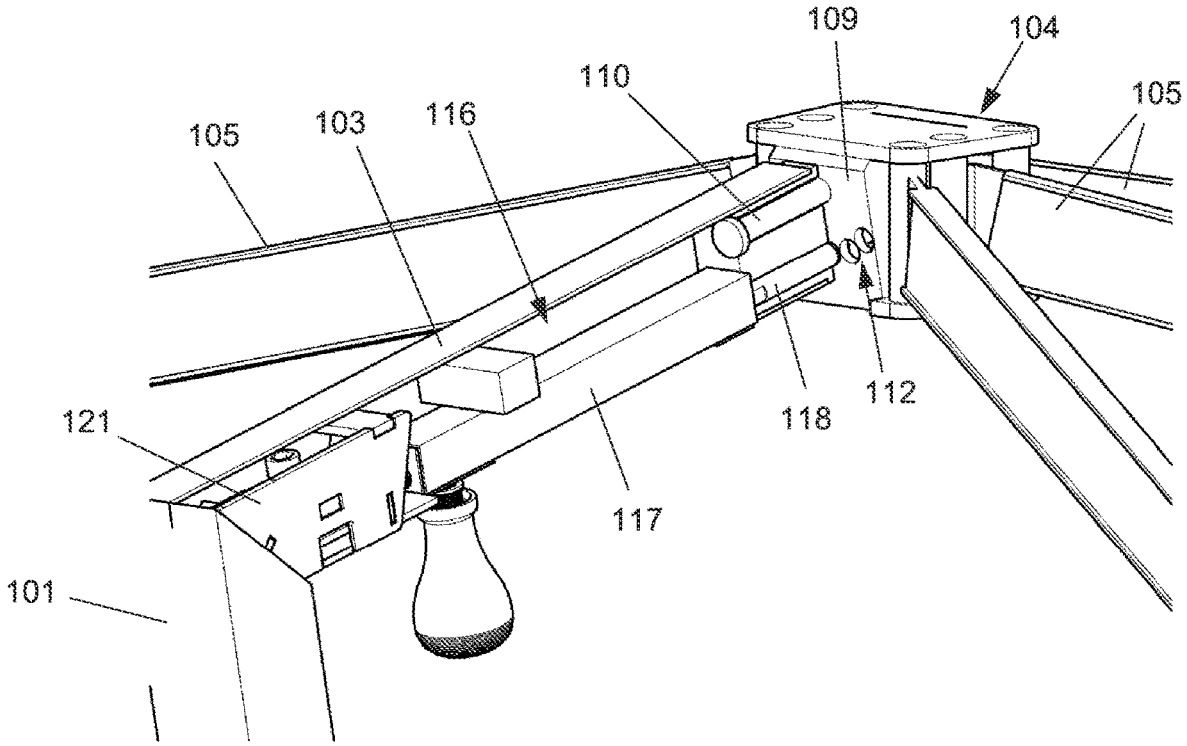
FIG. 18 is a three-dimensional view of the latch mechanism of the umbrella of FIG. 17.
Figure 19:
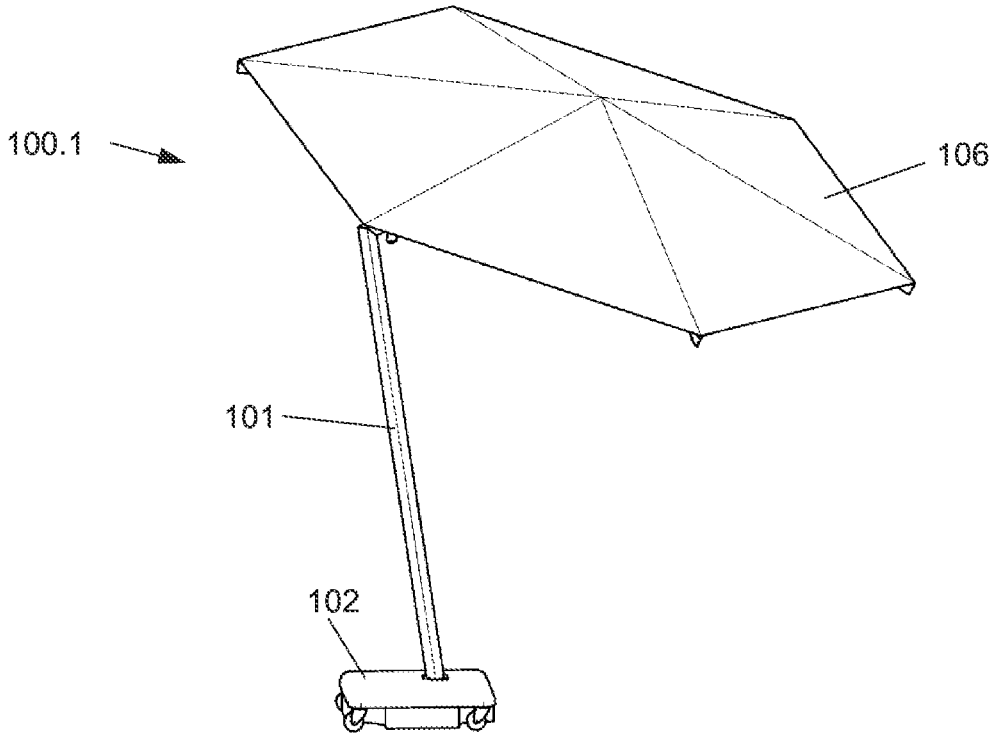
FIG. 19 is a three-dimensional view of the umbrella of FIG. 1 with its canopy partly pivoted right.
Figure 20:
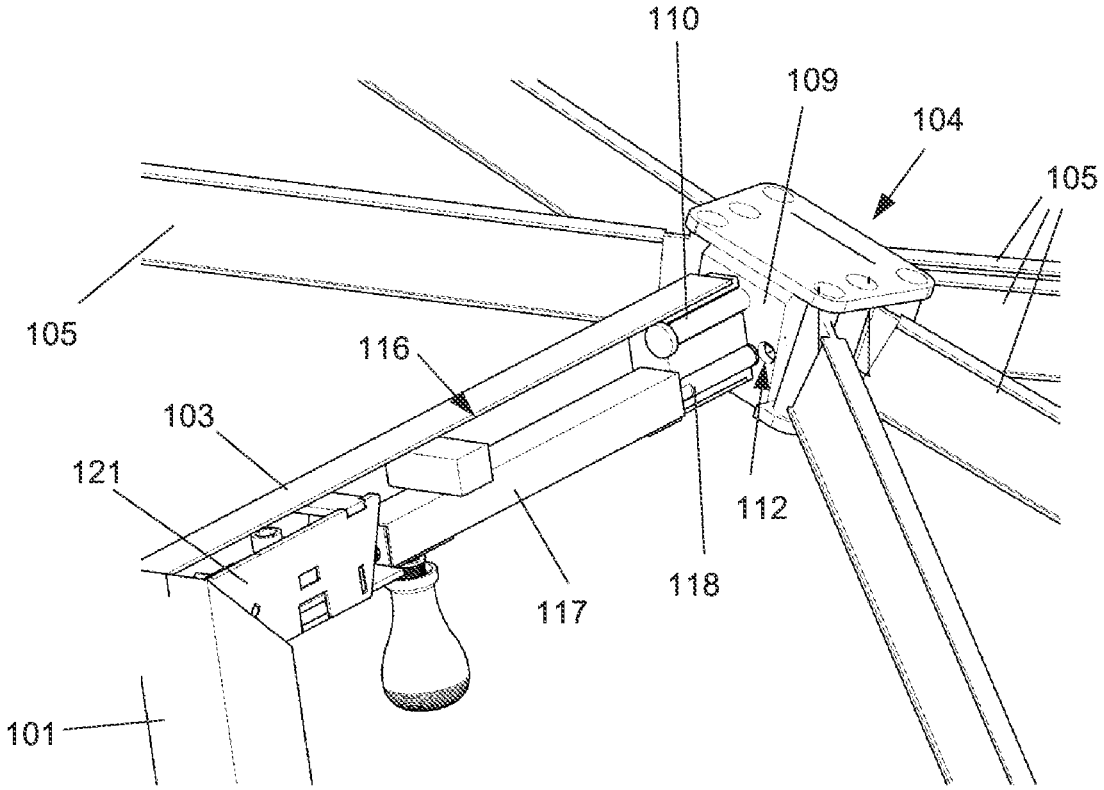
FIG. 20 is a three-dimensional view of the latch mechanism of the umbrella of FIG. 19.
Figure 21:
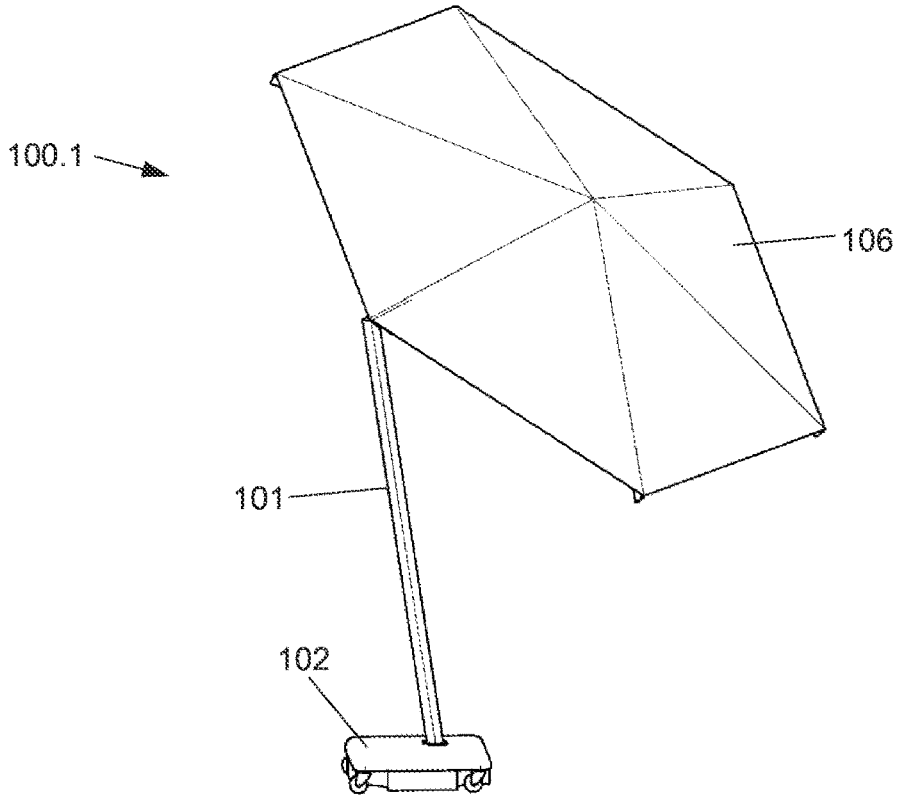
FIG. 21 is a three-dimensional view of the umbrella of FIG. 1 with its canopy fully pivoted right.
Figure 22:
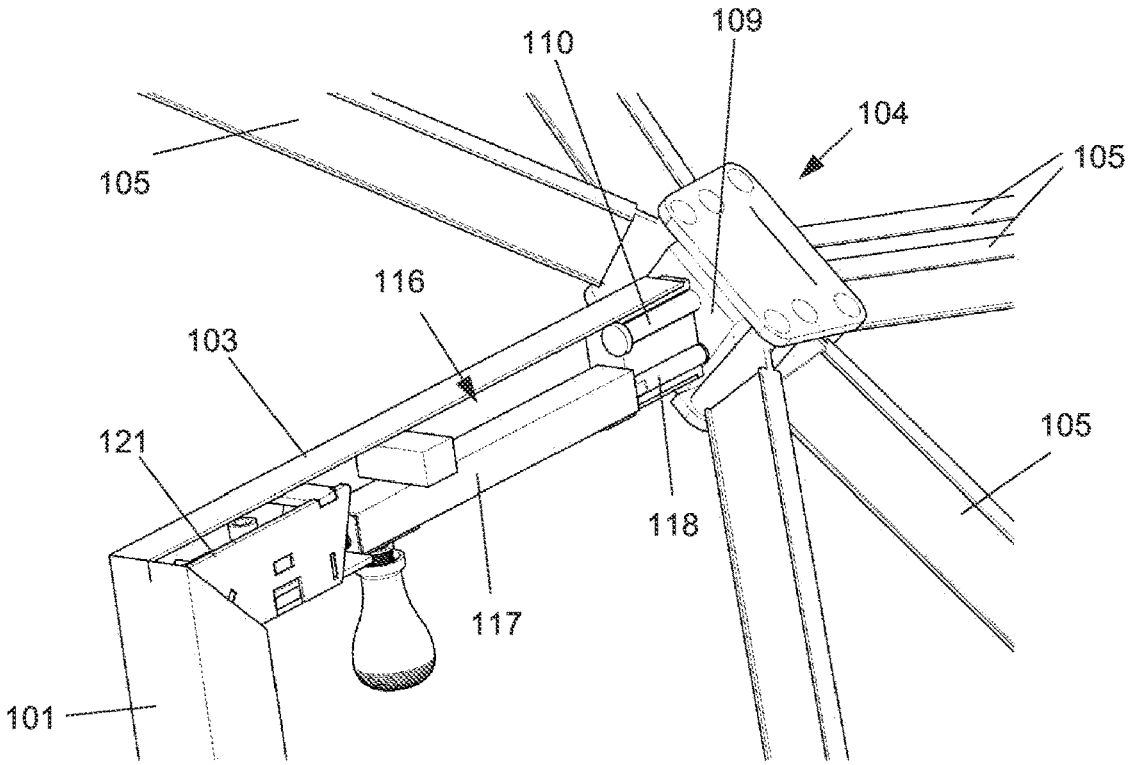
FIG. 22 is a three-dimensional view of the latch mechanism of the umbrella of FIG. 21.
Figure 23:
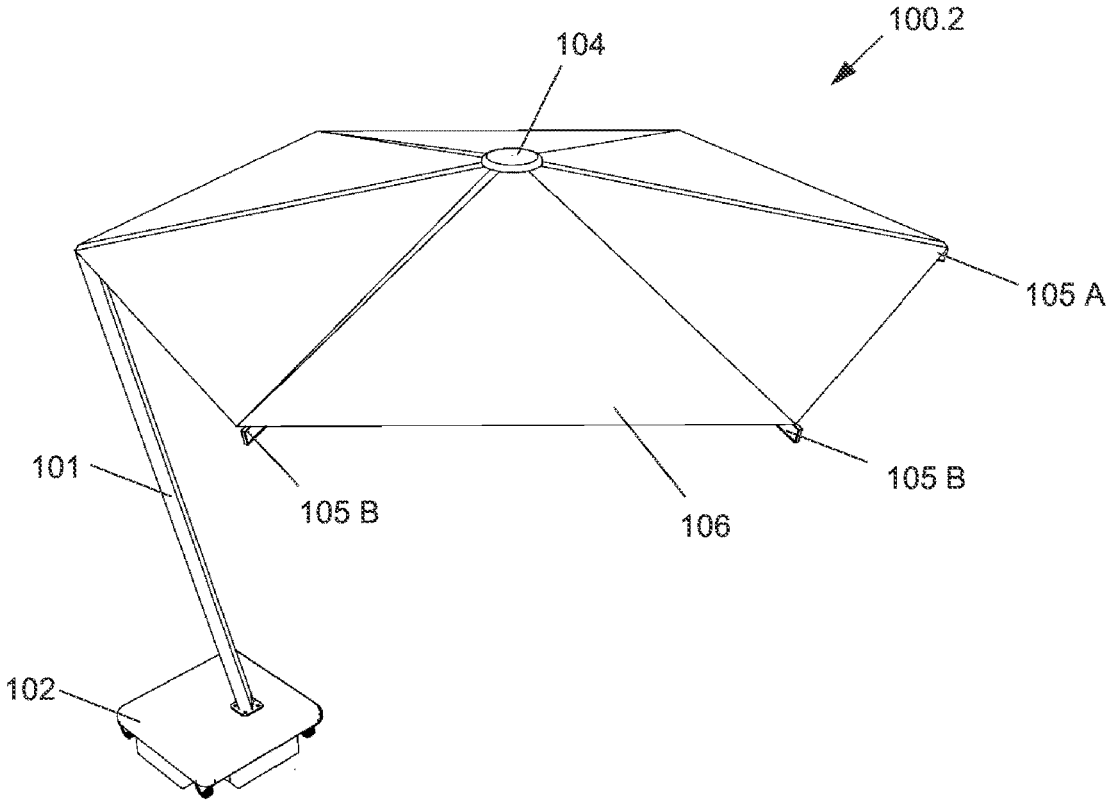
FIG. 23 is a top three-dimensional view of a second embodiment of an umbrella according to the present invention.
Figure 24:
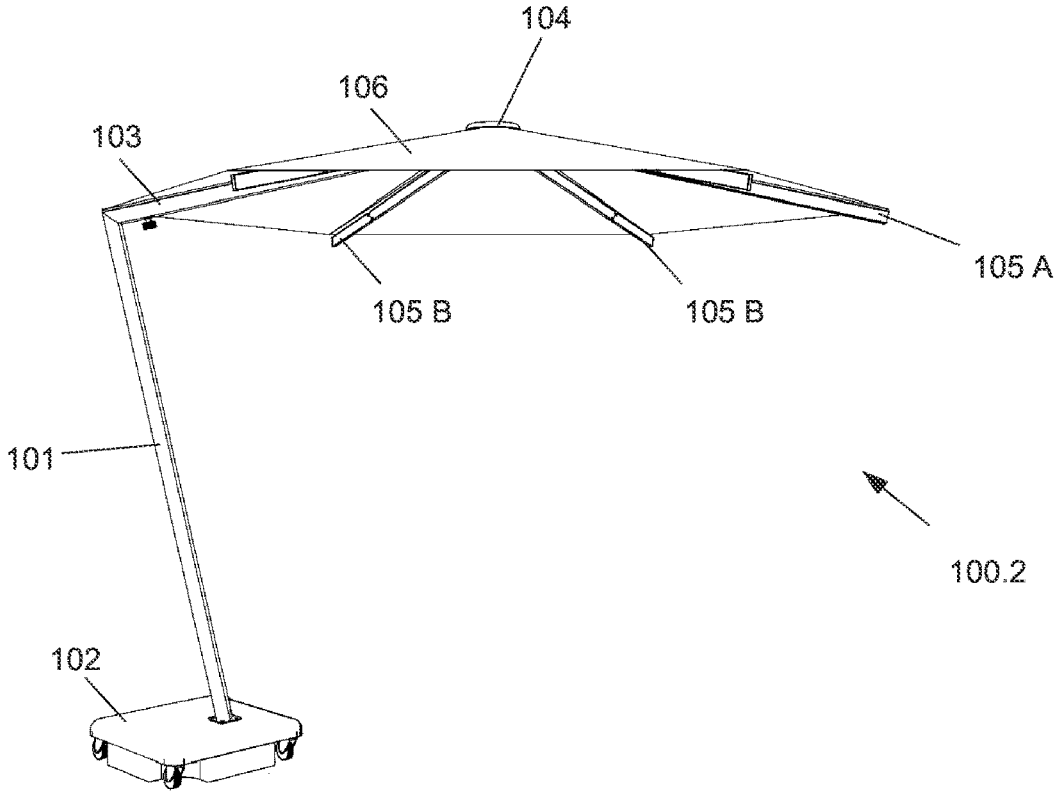
FIG. 24 is a side three-dimensional view of the umbrella of FIG. 23.
Figure 25:
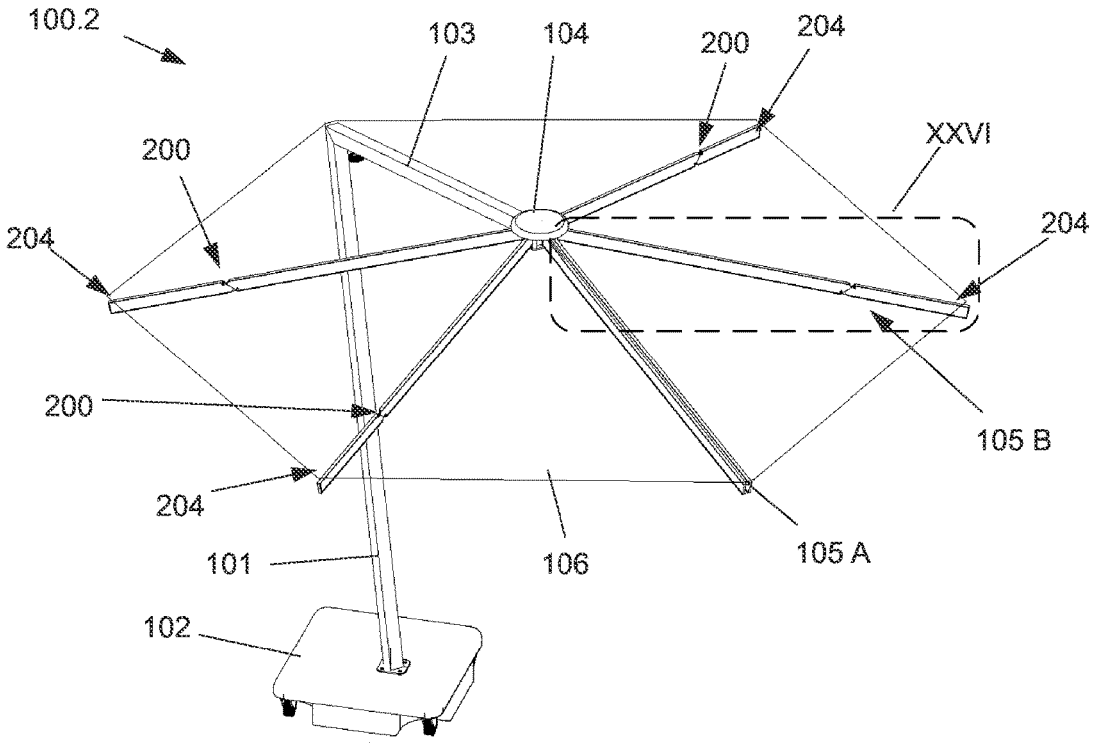
FIG. 25 is a three-dimensional view of the umbrella of FIG. 23 of from above with the canopy shown as transparent.
Figure 26:
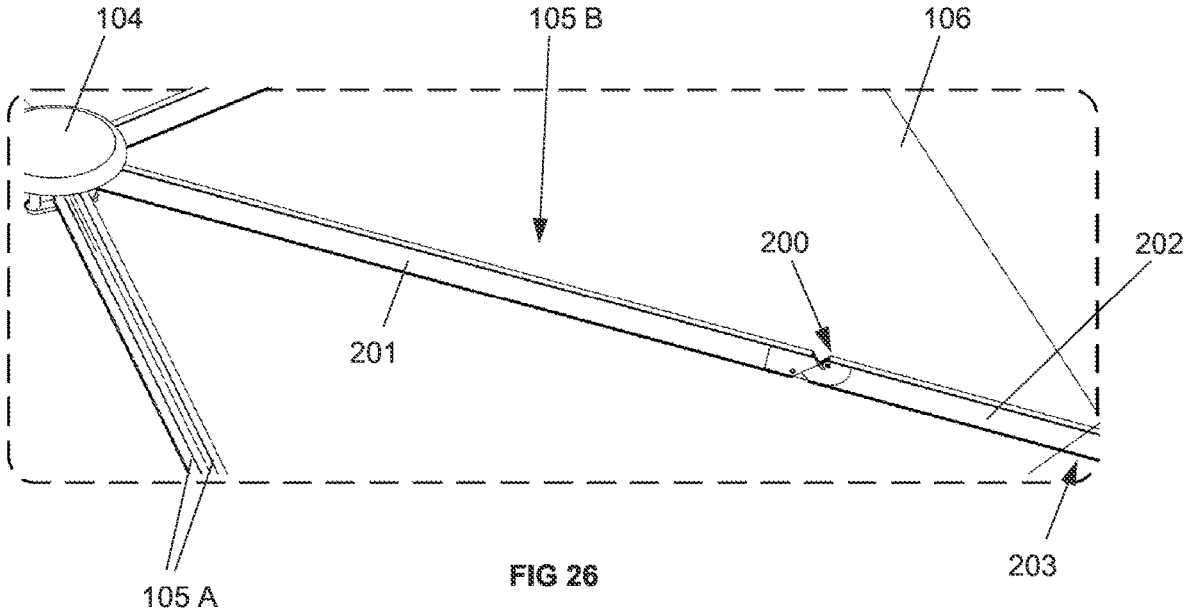
FIG. 26 is a detail view of the full length of one arm of the umbrella of FIG. 25, taken at XXVI.
Figure 27:
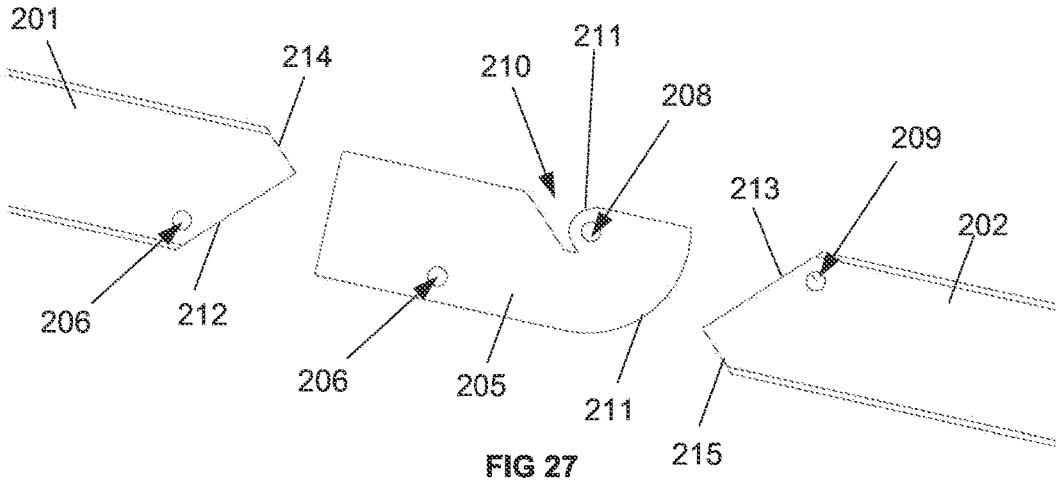
FIG. 27 is a cut-off exploded detail view of an arm of the umbrella of FIG. 23.

Referring to FIGS. 13 to 22, the umbrella canopy 106 is shown in various tilted positions, but the difference between these canopy positions, is simply that the latch pin 118 is in different locating holes 112. In particular:

- FIGS. 13 and 14 show the canopy fully pivoted left when the first of the locating holes 112 is engaged with the latch pin 118;
- FIGS. 15 and 16 show the canopy partly pivoted left when the latch pin engages the second locating hole;
- FIGS. 17 and 18 show the canopy horizontal, when the latch pin engages the third, middle locating hole;
- FIGS. 19 and 20 show the canopy partly pivoted right, when the latch pin engages the fourth locating hole; and
- FIGS. 21 and 22 show the canopy fully pivoted right, when the latch pin engages the fifth locating hole.

Referring to FIGS. 1 to 22, the umbrella 100.1 holds several advantages, including:

- The ability to tilt provides versatility to the umbrella, which can be adjusted to provide desired shade in different circumstances.

The relative simplicity of the tilt mechanism 110,114 and the latch mechanism 116 are cost-effective and reliable.

By providing the pivoting action at the hub 104, the cantilever forces on the pivoting mechanism are minimized.

The umbrella 100.1 is extremely easy to operate.

The mechanism has the feature of 'self' locating both the latch pin 118 in the locating holes 112 and the knob 125 mechanism, due to the shape of the latch pin and the spring 122,128 system and block control 124 of the knob.

Referring to FIGS. 23 to 37, a second embodiment of an umbrella 100.2 according to the present invention has several features in common with the first embodiment, shown in FIGS. 1 to 22, including that the umbrella 100.2 is a cantilever umbrella with a generally upright post 101 supported on a base 102, with a cantilever arm 103 extending from the post to a hub 104, with radial arms 105 extending from the hub.

The umbrella 100.2 is preferably a radially opening umbrella with radial arms 105 that are pivotally supported by the hub 104 to pivot about upright pivot axes along a domed plane, such as a conical plane between stowed and deployed positions. Two of the radial arms 105 form leading arms 105A that can pivot to opposing sides of the cantilever arm 103 when the umbrella is stowed, and can pivot to the side-by-side positions shown in the drawings where the leading radial arms are latched together in a position that is opposite from the cantilever arm 103, when the umbrella is deployed.

The other radial arms are following arms 105B that are pulled to their deployed positions and are held in position, by the canopy 106. Radial opening is a preferred feature of the umbrella 100.2, but is it not essential to the present invention. However, it is essential that the radial arms 105 support the canopy 106 in a domed shape such as a cone, i.e. in a shape that protrudes upwardly when the canopy is horizontal. In the event that the canopy 106 is horizontal, each of the radial arms will extend downwards from the hub 104 towards the periphery of the canopy. If the canopy 106 is tilted, it still has a domed shape, but references to "up" and "down" no longer apply.

In the illustrated second embodiment of an umbrella 100.2, each of the leading radial arms 105A is solid, whereas each of the following radial arms 105B includes a hinge mechanism 200 between an inner, longer part 201 that is pivotally attached to the hub 104 and a shorter, outer part 202 that extends from the hinge mechanism to a distal end 203 of the radial arm. The canopy 106 is attached to each of the outer parts 202 at fixing points 204 in the vicinities of the distal ends 203, but is preferably also attached to the inner parts 201.

In other embodiments of the invention, an umbrella may include differently configured radial arms, e.g. the umbrella may have a central post or its arms may open conventionally and any number of the radial arms of such an umbrella could have the features of the following radial arms 105B described herein.

Various alternative configurations of hinge mechanisms 200 could be used, but in the preferred, illustrated example, the hinge mechanism includes a hinge plate or hinge element 205 that is fixedly connected to the inner part 201. The inner part 201 is preferably hollow and one end of the hinge element is inserted inside the distal end of the inner part and is attached with a fastener through apertures 206 on the inner part and hinge element.

The hinge element 205 is also attachable to the outer part 202, but this attachment is a pivotal attachment that is achieved in the illustrated embodiment by a fastener such as a capped screw 207 that is passed through pivot apertures 208 and 209 on the hinge element 205 and outer part 202, respectively.

The pivot element 205 includes a notch 210 and two rounded profiles 211 that radiate from the pivot aperture 209 to accommodate pivotal movement of the outer part 202 relative to the pivot element, about the pivot axis of the capped screw 207.

The distal end of the inner part 201 is cut to form inner stop formations in the form of angled inner meeting faces 212 and the end of the outer part 202 that is pivotally attached to the hinge element 205 is cut to form outer stop formations in the form of angled outer meeting faces 213. The inner and outer meeting faces 212,213 have opposite, complemental shapes and orientations, so that they butt together when the inner and outer parts 201,202 are aligned. In the illustrated embodiment, each of the inner and outer faces 212,213 is oriented at about 45 degrees relative to the inner and outer parts 201,202, respectively, but this angle is not essential. Each of the inner and outer parts 201,202 is also cut to form a bevel face 214,215 that is at a right angle relative to the inner and outer meeting faces 212,213. One purpose of the bevel faces 214,215 is to avoid dangerous sharp points on the inner and outer parts 201,202 and the angles of the bevel faces are not essential for this purpose, but the inner bevel face 214 also serves as a stop formation when the outer part is activated (see below) and its orientation is important for this purpose and preferably aligns with a side of the notch 210.

Figure 28:
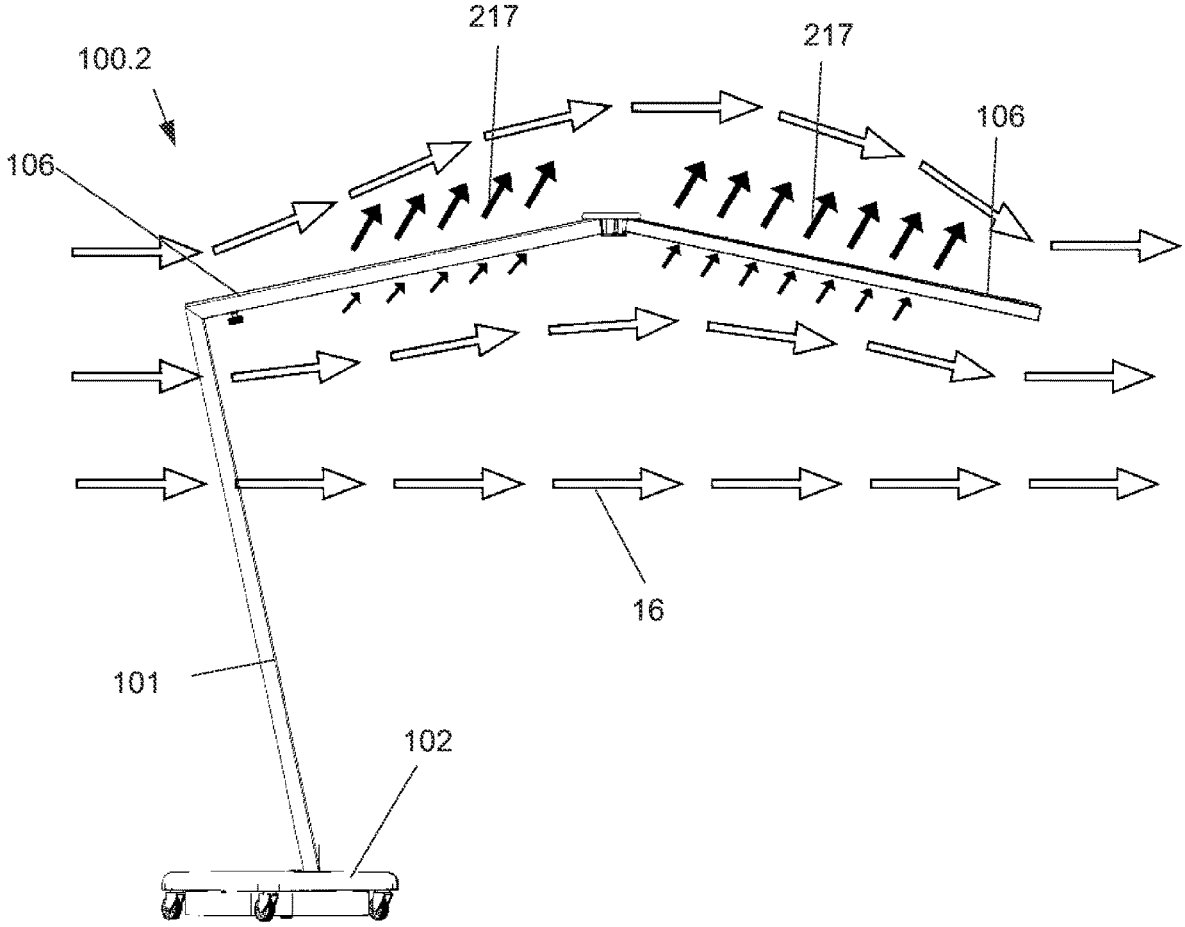
FIG. 28 is a diagrammatic section through the umbrella of FIG. 23 showing wind flow and resulting lift.

FIG. 28 shows the forces that activate the hinged wind damage mitigation mechanism according to the present invention. In this drawing, lateral wind movement 216 is indicated with large arrows. This lateral wind movement 216 is distorted by the domed shape of the canopy 206, which acts much like an aerofoil, causing an aerodynamic reaction in the form of lift 217 that urges the canopy 206 upwards. This lift 217 is the force that typically 'blows over' umbrellas and causes damage to the umbrella and surroundings.

Figure 30:
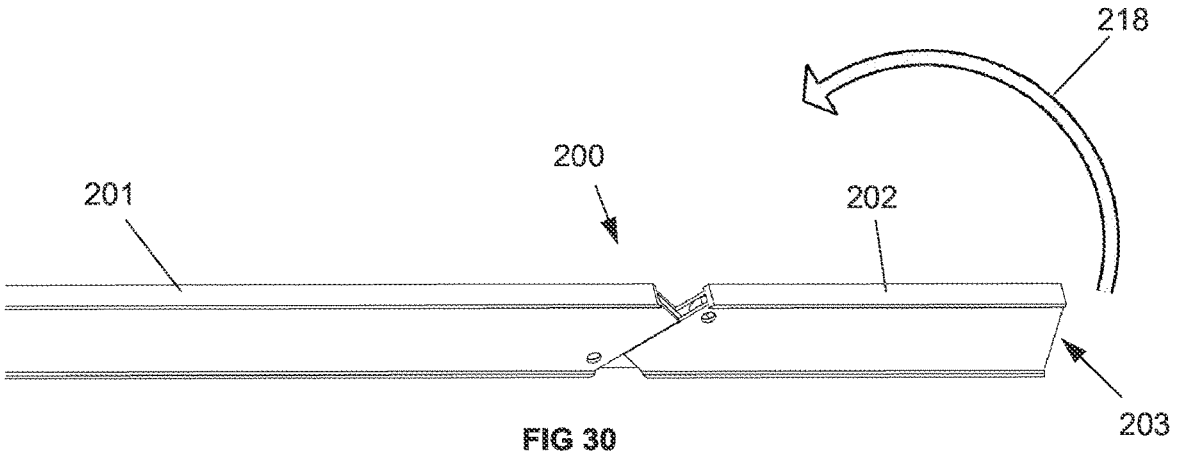
FIG. 30 is a diagrammatic side view of a hinged connection on an arm of the umbrella of FIG. 23 in a typical condition with the control mechanism un-activated.

FIG. 30 shows the hinge mechanism 200 in an un-activated condition in which the inner part 201 and outer part 202 are aligned with the inner and outer meeting faces 212,213 in abutment—which stops the outer part 202 from pivoting downwards. The canopy 106 is under slight tension and owing to its domed shape, there is circumferential tension in the canopy between the distal ends 203 of the outer parts 202 and this circumferential tension prevents the distal end from pivoting upwards. (The terms upwards and downwards are used in this context with reference to a horizontal canopy orientation. If the canopy is not horizontal, the upwards and downwards pivoting can be described as pivoting towards and away from the hub, respectively.)

Figure 31:
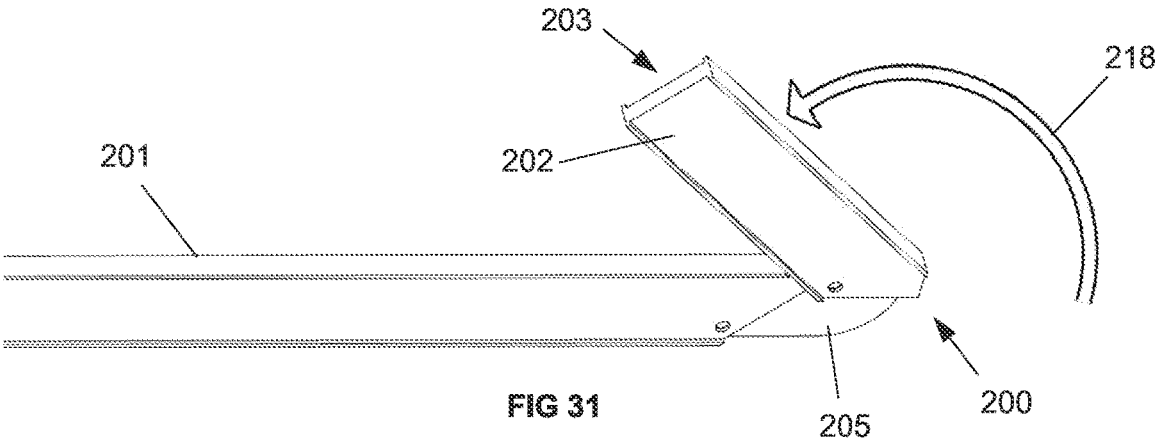
FIG. 31 is a diagrammatic side view of the hinged connection of FIG. 30 in an atypical condition with the control mechanism activated.

In the event that sufficient lift 217 is exerted on the outer part 202 (or on the canopy 106, which transfers the lift to the outer part), and the lift is strong enough to overcome the circumferential tension in the canopy, the outer part can pivot upwards in an activating direction 218 about the pivot aperture 209 to an activated condition as shown in FIG. 31.

Figure 29:
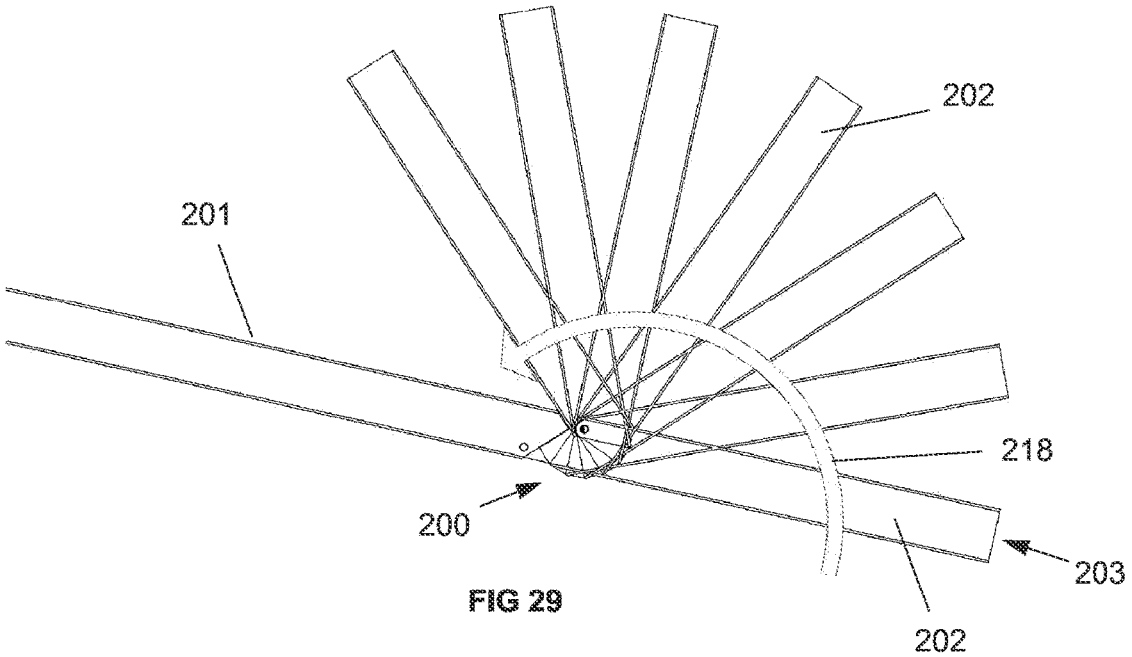
FIG. 29 is a diagrammatic side view of an arm of the umbrella of FIG. 23 with progressive activation of a control mechanism.

FIG. 29 illustrates the pivot action of the outer part 202 as described above with reference to FIGS. 30 and 31.

Figure 32:
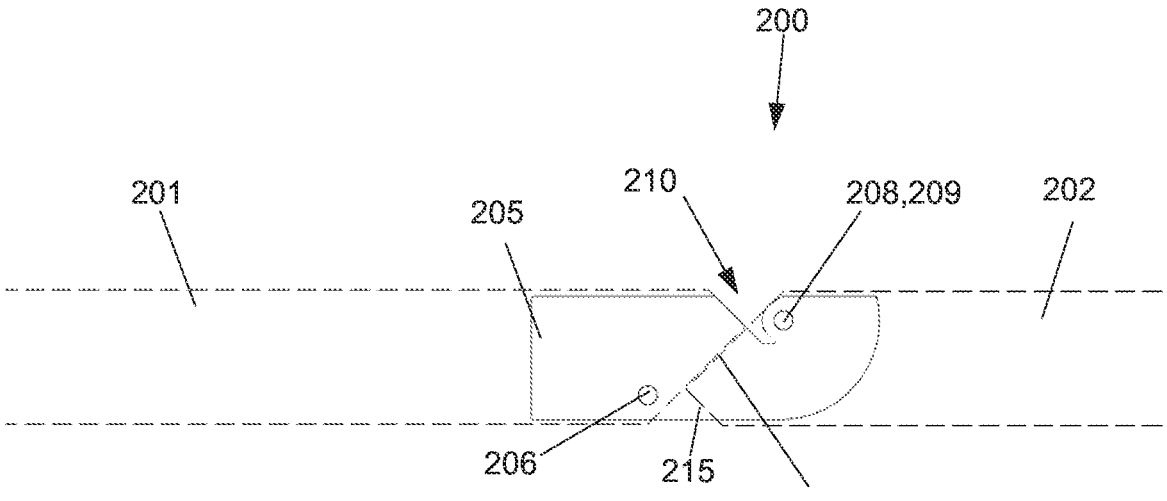
FIG. 32 is a diagrammatic side view of a hinge plate of the umbrella of FIG. 23 in an un-activated condition, with arm portions shown in broken lines.

FIG. 32 explains the specific geometries of the hinge element 205 and the ends of the inner and outer parts 201,202 with the umbrella 100.2 in the un-activated condition, as follows:

The hinge element 205 is fixedly constrained by the walls of the inner part 201 and fixed attachment at the fastening apertures 206. In the un-activated condition the top and bottom walls of the outer part 202 are constrained by the downward forces of the canopy 106 caused by the domed or conical shape of the radial arms 105 and resultant tension in the perimeter of the canopy.

The long 45-degree angled inner and outer meeting faces 212 and 213 ends 19 meet and abut in this configuration.

Figure 33:
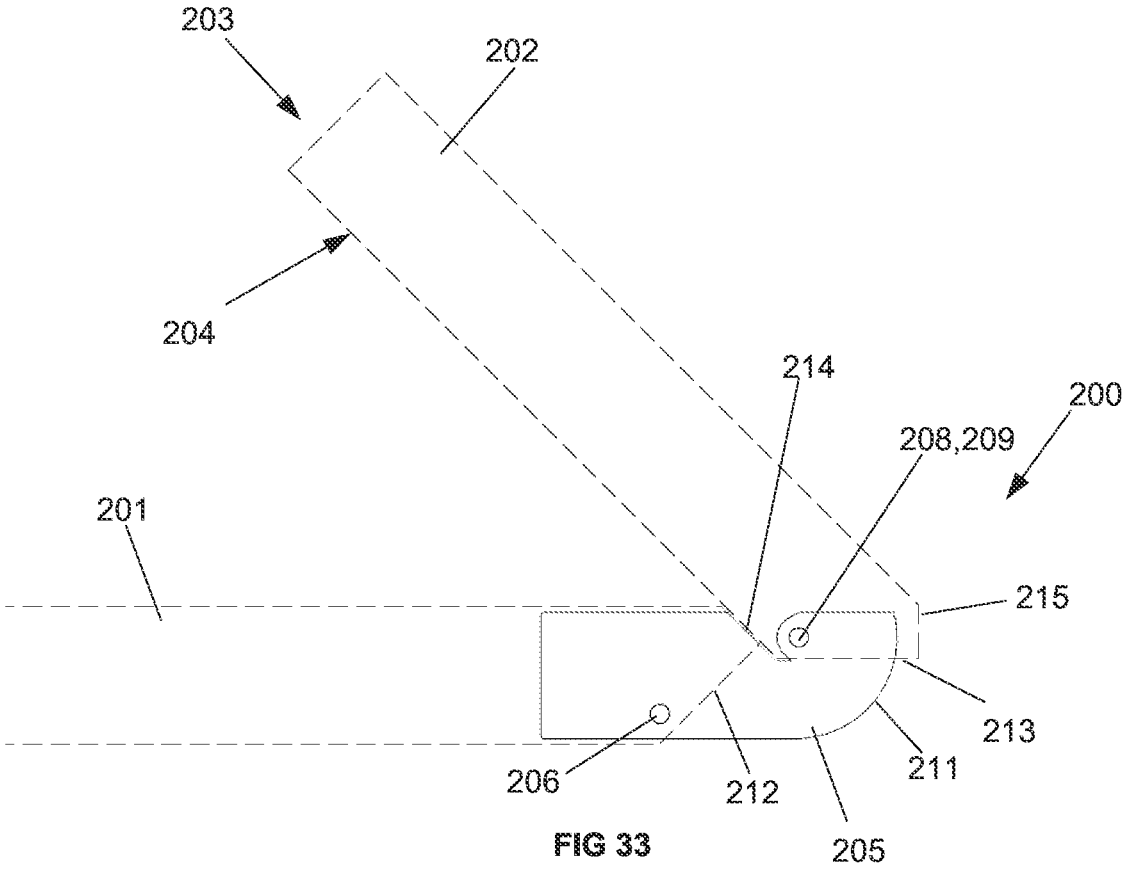
FIG. 33 is a diagrammatic side view of the hinge plate of FIG. 32 in an activated condition.

FIG. 33 explains the specific geometries of the hinge element 205 and the ends of the inner and outer parts 201,202 with the umbrella 100.2 in the activated condition, as follows:

The hinge element 205 remains fixedly constrained by the walls of the inner part 201 and attachment via the fastening apertures 206. The outer part 202 is pivoted about pivot aperture 209 and rests on the 45-degree angled bevel face 215 and face of the notch 210.

Figure 34:
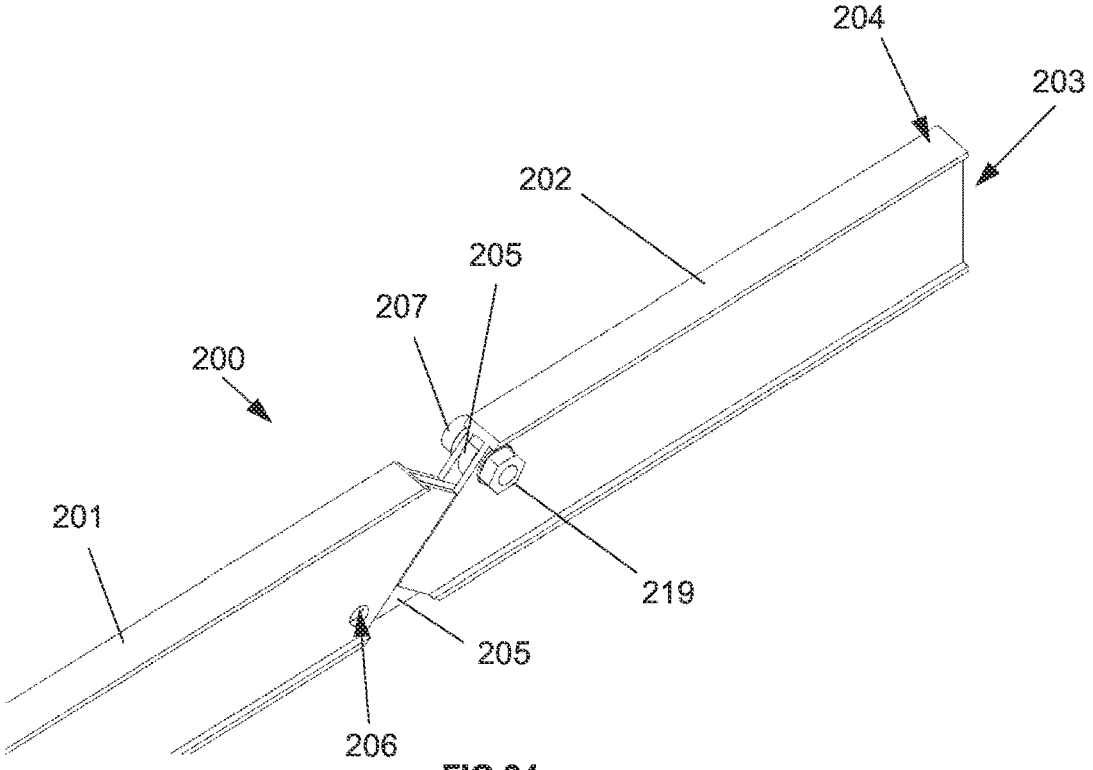
FIG. 34 is a three-dimensional view of a hinge of an arm of the umbrella of FIG. 23.
Figure 35:
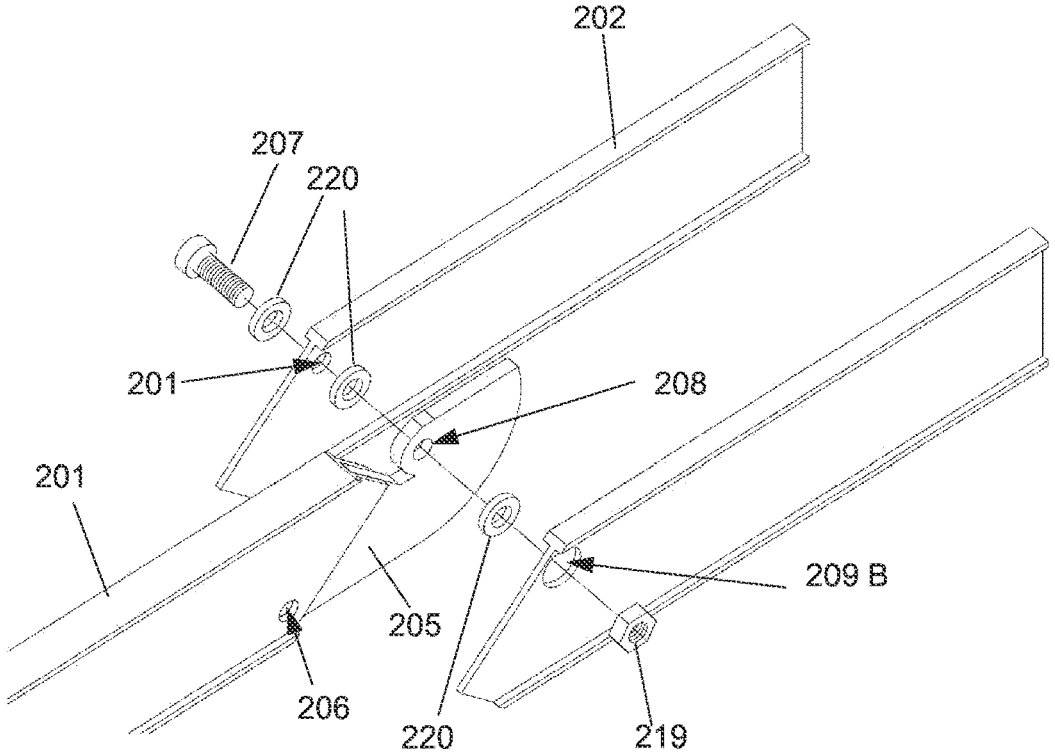
FIG. 35 is an exploded view of the hinge of FIG. 34.

Referring to FIGS. 34 and 35, detail of a preferred embodiment of the hinge mechanism 200 is shown, but the inner and outer parts 201,202 are both hollow rectangular tubes and for the sake of illustration, the outer part 202 is shown split in FIG. 35.

In order to ensure a desired stiffness in the pivotal action between the outer part 202 and the hinge element 205, without excessive friction or excessive play between the hinge element and the inside of the outer part, the one pivot aperture 209A Is sized to receive the shank or threaded part of the capped screw 207, but the other pivot aperture 209B is larger, so that a nut that is fitted on the caped screw 207, is partly received inside the larger pivot aperture. Washers 220 are fitted on opposing sides of the hinge element 205 and the wall of the outer part 202 through which the capped screw 207 extends. This provides a torturable hinge connection that cooperates with tension in the canopy 106 to hold the outer parts 202 in alignment with the inner parts 201 and provides resistance to the outer parts of the arms activating when opening the umbrella 100.2 and before the canopy is under tension.

Figure 36:
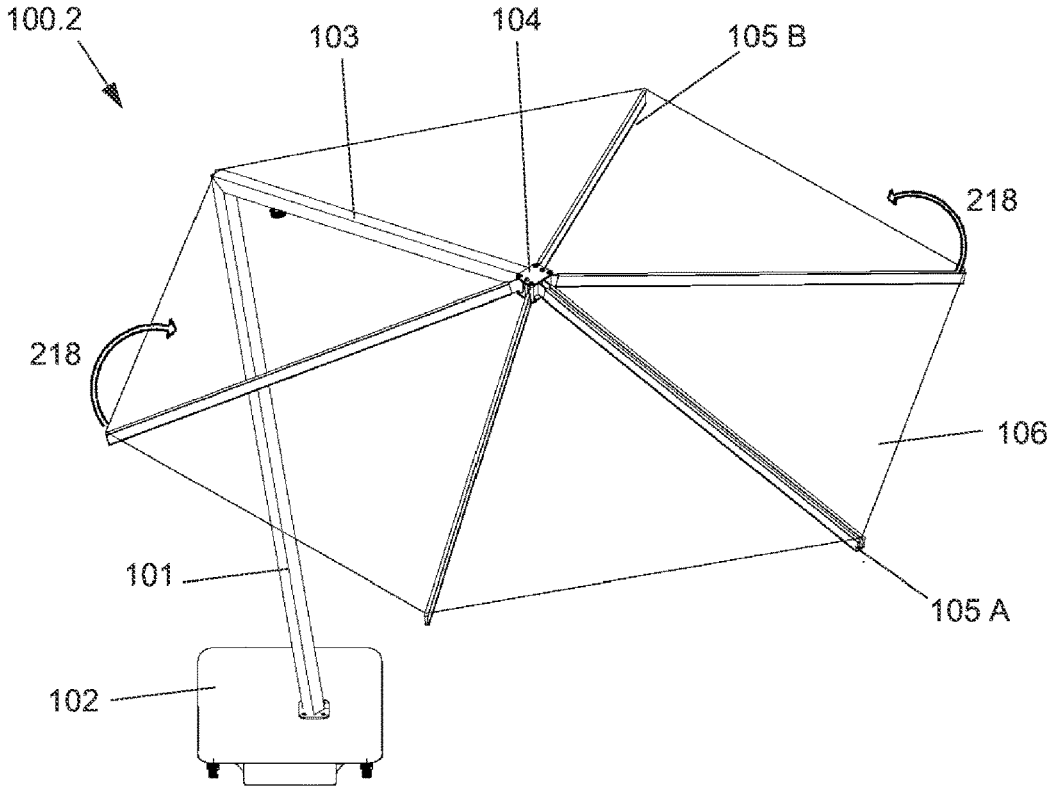
FIG. 36 is a three-dimensional view of the umbrella of FIG. 23 in the typical condition where the control mechanism is un-activated
Figure 37:
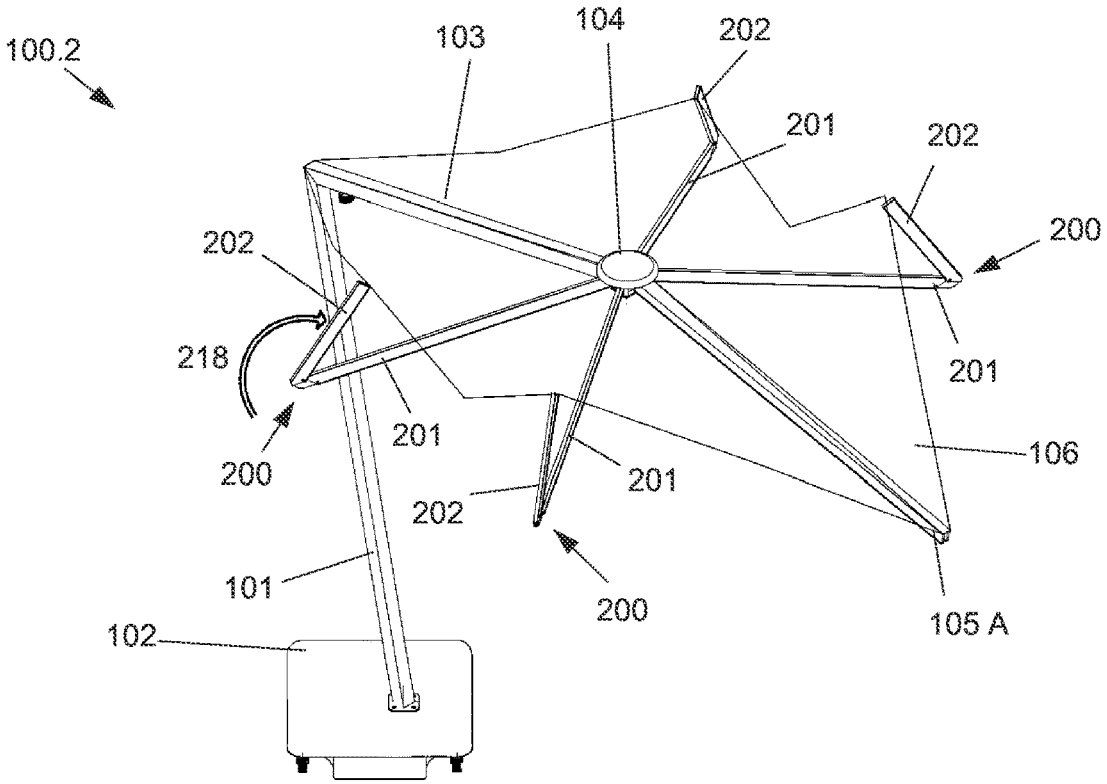
FIG. 37 is a three dimensional view of the umbrella of FIG. 36 in the atypical condition where the control mechanism is activated.
Figure 38:
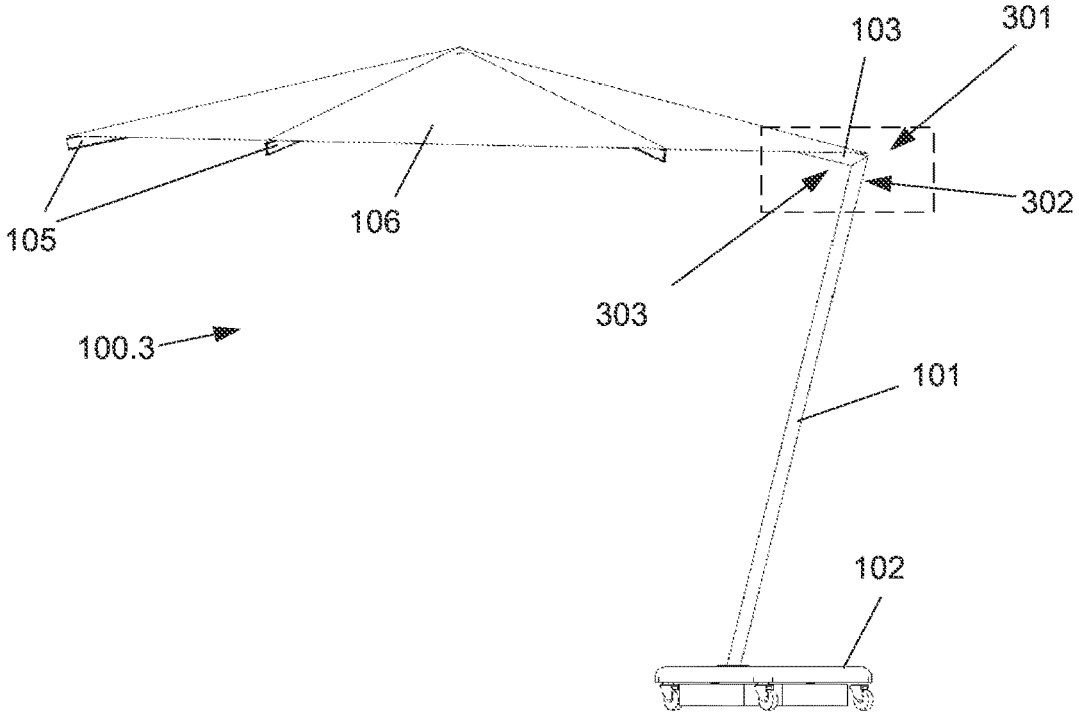
FIG. 38 is an elevation of a third embodiment of an umbrella according to the present invention.
Figure 39:
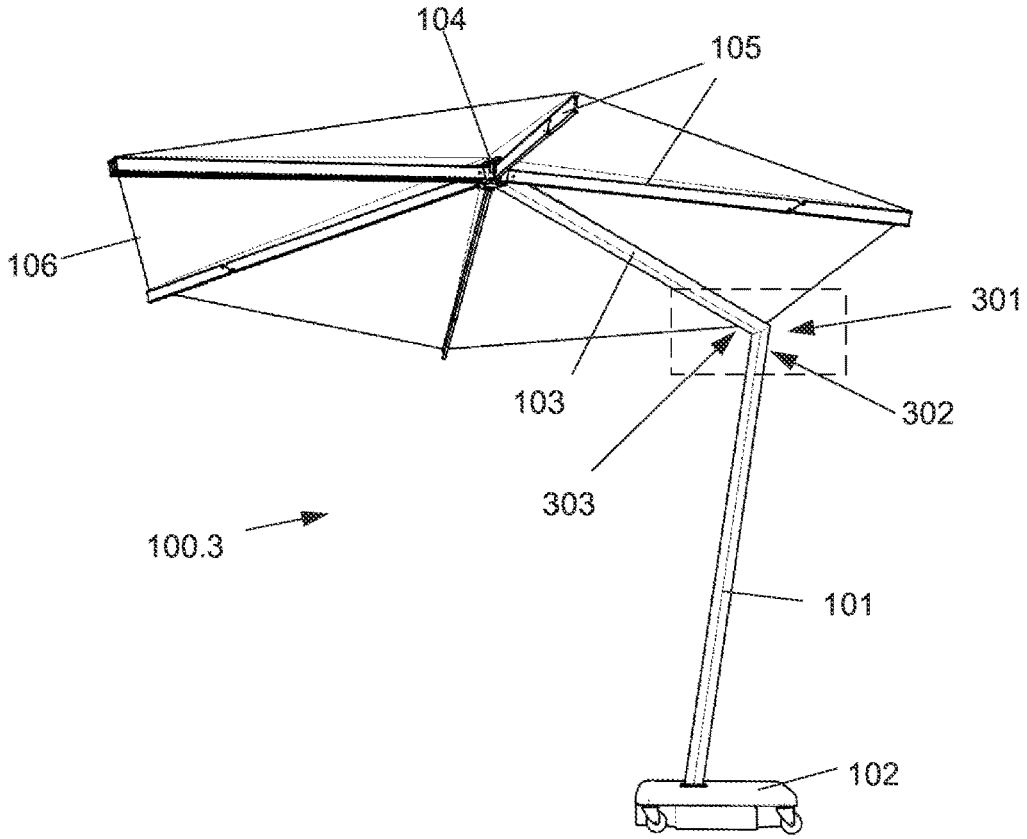
FIG. 39 is a three-dimensional view of the umbrella of FIG. 38, from below.
Figure 40:
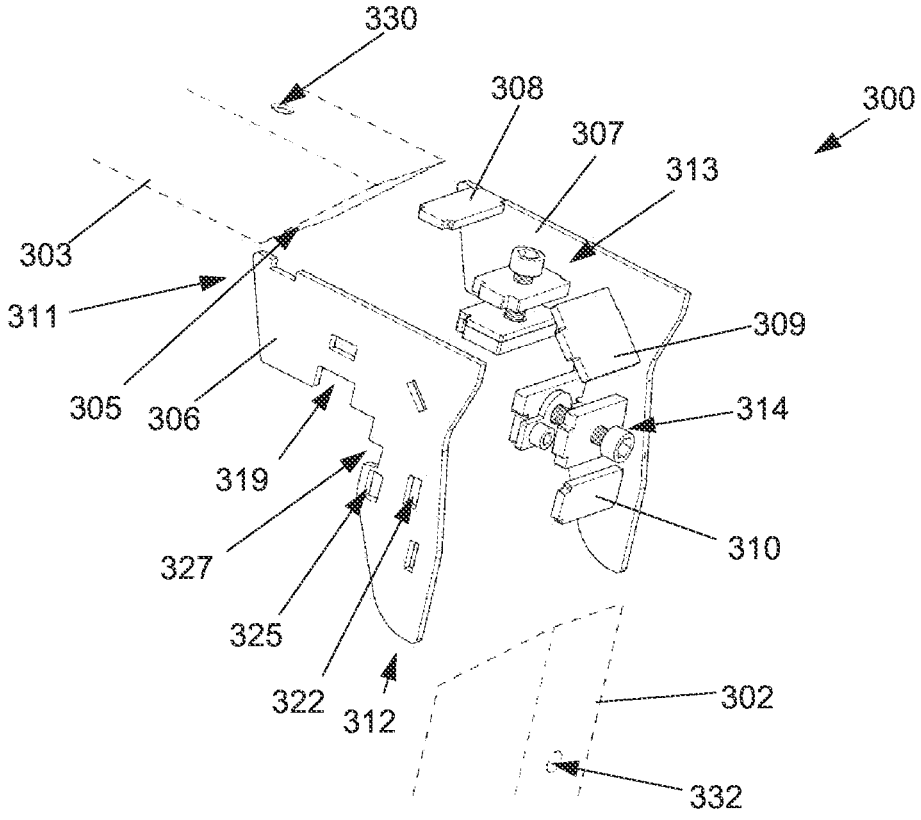
FIG. 40 is a three-dimensional partially exploded view of an angle bracket of the umbrella of FIG. 38, showing all components and sub-assemblies, with a left side plate floating, for clarity.
Figure 41:
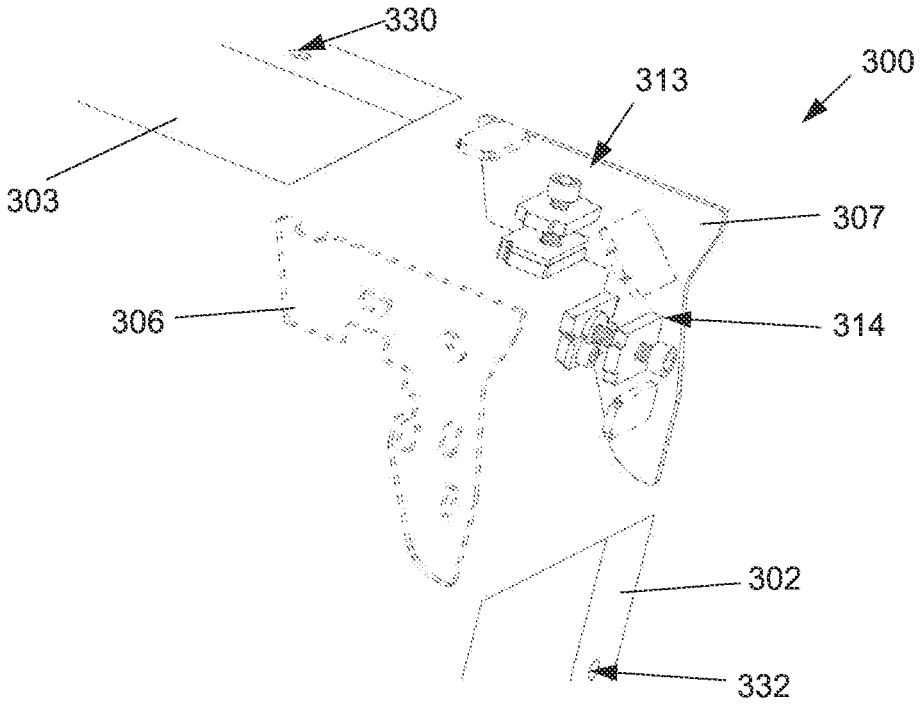
FIG. 41 is a three-dimensional partially exploded view of the angle bracket of FIG. 40, showing a right-side plate and the two pressure-plate sub-assemblies of the angle bracket with the left side plate and spacers in broken lines.
Figure 42:
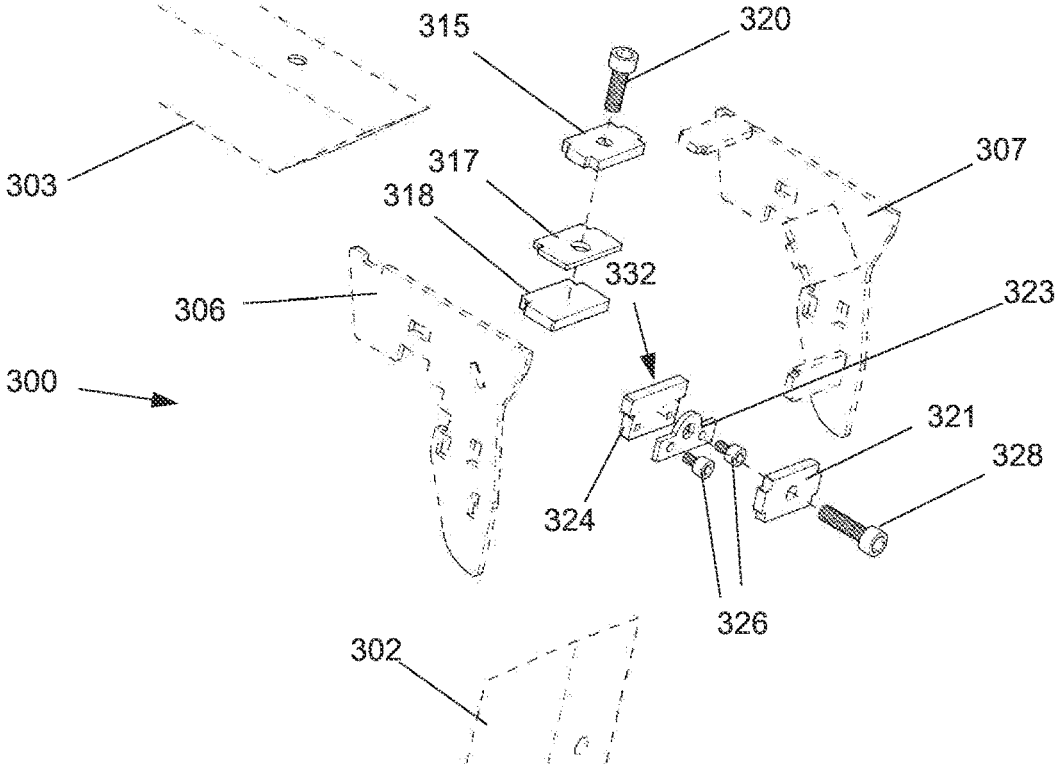
FIG. 42 is a three-dimensional fully exploded view of the angle bracket of FIG. 40, showing all components of the pressure-plate sub-assemblies, with the side plates and spacers in broken lines.
Figure 43:
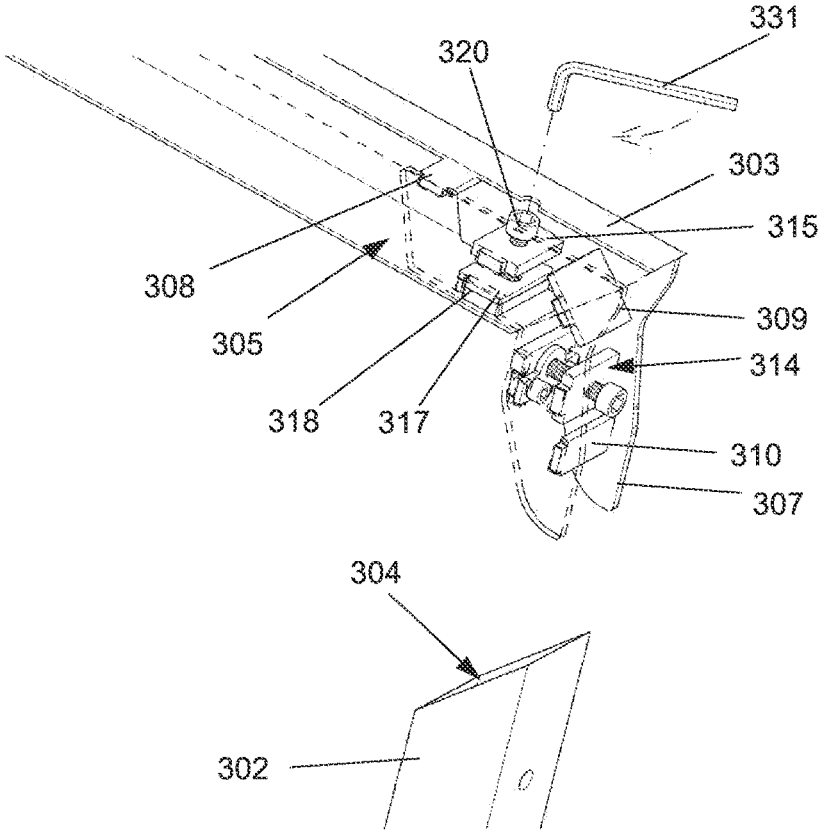
FIG. 43 is a three-dimensional view of the angle bracket of FIG. 40, showing the position of the angle bracket in a cantilever arm.
Figure 44:
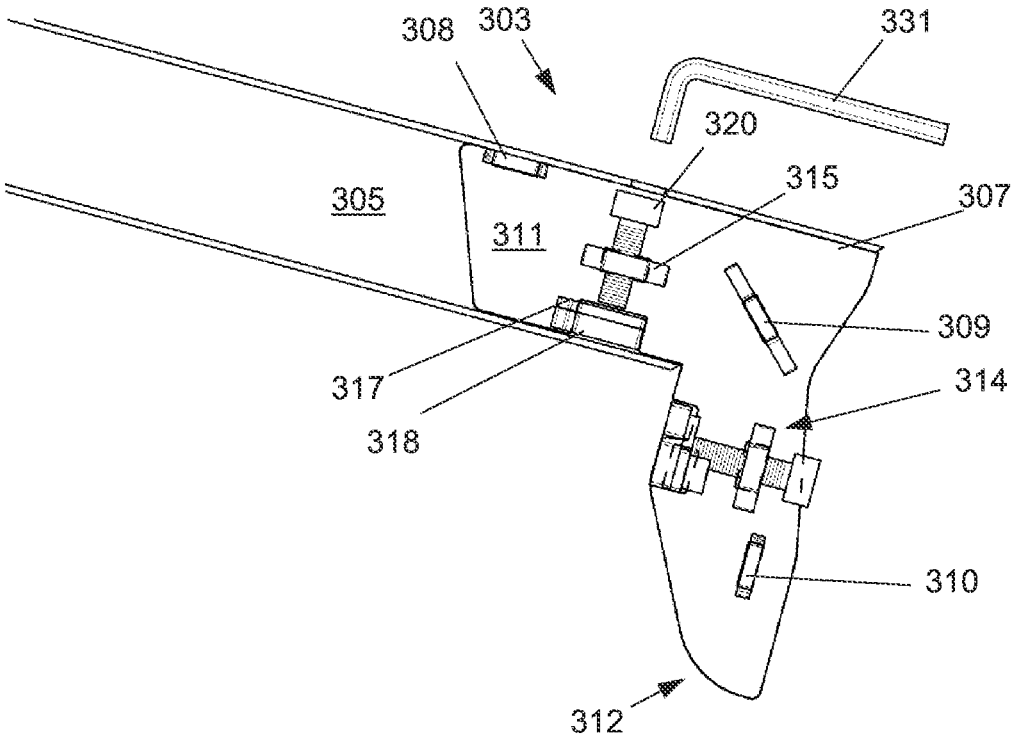
FIG. 44 is an elevation showing the angle bracket of FIG. 40 inserted into the cantilever arm in an un-clamped condition.
Figure 45:
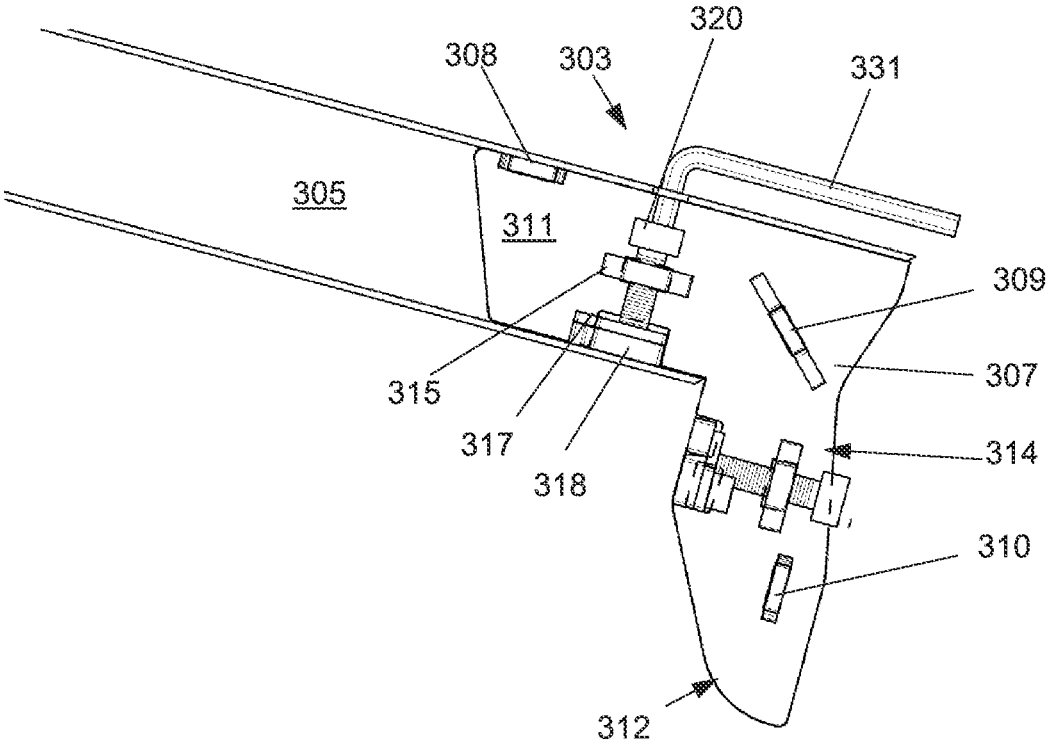
FIG. 45 is an elevation showing the angle bracket of FIG. 40 clamped into the cantilever arm.

FIG. 36 shows the umbrella 100.2 in the un-activated condition and FIG. 37 shows the umbrella in the activated condition, as described above.

In use, under normal wind conditions the umbrella 100.2 in the open condition is structurally stable, with the canopy 106 in tension between the distal ends 23 of the outer parts 202 of the following radial arms 105B due to its attachment to the fixing points 204 and along the lengths of the leading radial arms 105A.

Under extreme wind conditions the lateral winds 216 cause lift 217 on the umbrella canopy 106. This lift 217 causes upward pressure on the fixing points 204 at the distal ends 203 of the following radial arms 105B. When the lift 217 overcomes the tension in the perimeter of the canopy 106, the outer part 202 of the following radial arm 105B will pivot upwards (towards the hub) about the capped screw 207 and come to rest in the notch 210 of the hinge element 205. This release the pressure on the fabric of the canopy 106—and thereby removes the lift forces 217.

Once the risk of strong wind has abated sufficiently, in-order-to return the umbrella 100.2 to its normal operating condition, the outer parts 202 of the following radial arms 1058 are pivoted manually to their original position.

Referring to FIGS. 23 to 37, the umbrella 100.2 holds several advantages, including:

Substantial mitigation of the risk of wind to the umbrella 100.2 and/or damage to the umbrella's surroundings.

It provides longevity to umbrellas.

The mechanism is simple and cost effective.

Referring to FIGS. 38 to 51, a third embodiment of an umbrella 100.3 according to the present invention has several features in common with the first and second embodiments, shown in FIGS. 1 to 37, including that the umbrella 100.3 is a cantilever umbrella with a generally upright post 101 supported on a base 102, with a cantilever arm 103 extending from the post 101 to a hub 104, with radial arms 105 extending from the hub and supporting a canopy 106. The purpose of the cantilever arm 103 is to bear the loads such as weight and wind load, of the canopy 106 and to transfer those loads to the post 101.

In the illustrated embodiment, the cantilever arm 103 is aligned with the planes of the radial arms 105 and the canopy 106, but in other embodiments, the cantilever arm could be above or below the hub 104, arms 105 and canopy 106—which can also have different configurations.

In the illustrated embodiment, the post 101 and cantilever arm 103 are both raked and extend at a small angle relative to vertical and horizontal, respectively and are joined at a right angle. However, the invention is not limited to these orientations or to right angles.

The post 101 and cantilever arm 103 are attached together by an internal angle bracket that is generally identified by reference sign 300. The angle bracket 300 is generally similar to the angle bracket 121 shown in FIGS. 5-22, with the only differences being that the angle bracket 121 has the slot 120 and lip 123 that allows it to be used with the latch mechanism 116 shown in FIGS. 3-22.

Referring to FIGS. 38 to 51, the post 101 and the cantilever arm 103 are made of hollow square metal tubes and meet at a junction 301 of an upper end 302 of the post and a proximal end 303 of the cantilever arm. In other embodiments of the invention, the post 101 and cantilever arm 103 need not be hollow for their entire length and need not be made of square tubing or of metal, but it is required that the post be hollow at its upper end 302 to define an internal post cavity 304 and that the cantilever arm be hollow at its proximal end 303 to define an internal arm cavity 305. The angle bracket 300 is preferably concealed in its entirely inside the post cavity 304 and arm cavity 305.

The angle bracket 300 includes a main body that comprises of a profiled left side plate 306 and an identical or mirrored right side plate 307, that are held apart in a parallel configuration by a top spacer 308 in the form of a horizontal spacing plate, middle spacer 309 in the form of a diagonal spacing plate and bottom spacer 310 in the form of a vertical spacer plate, that each have lateral tabs that are received in four-sided apertures or recesses in the left and right side plates.

Each of the side plates 306,307 is profiled and is generally L-shaped so that the body of the angle bracket 300 forms a horizontal protuberance 311 and a vertical protuberance 312. The horizontal protuberance 311 is shaped and dimensioned to slide easily into the arm cavity 305 and a vertically expanding sub-assembly 313 is provided in the horizontal protuberance, between the side plates 306,307 that clamps the angle bracket 300 into the arm cavity 305. Similarly, the vertical protuberance 312 is shaped and dimensioned to slide easily into the post cavity 304 and a horizontally expanding sub-assembly 314 is provided in the vertical protuberance, between the side plates 306,307 that clamps the angle bracket 300 into the post cavity 304.

The components of the vertically expanding sub-assembly 313 include a fixed plate 315 with tabs that are fixedly constrained by four-sided locating slots 316 defined in the side plates 306,307, and a holed locating plate 317 and a pressure plate 318, both of which have tabs that are slidingly constrained by three-sided cut-outs 319 in the side plates 306,307, but can slide up and down by small distances. A pressure screw 320, which in the illustrated embodiment is an Alan cap screw, is screwed into a threaded hole in the fixed plate 315 and is held in position by the hole in the locating plate 317 and applies downward pressure to the pressure plate 318 when it is turned clockwise.

On the outside of the horizontal protuberance 311, the pressure plate 318 of the vertically expanding sub-assembly 313 provides a pressure-contact face that can press downwards against the inside of the arm cavity 305 when the pressure screw 320 is turned clockwise.

The components of the horizontally expanding sub-assembly 314 include a fixed plate 321 with tabs that are fixedly constrained by four-sided locating slots 322 defined in the side plates 306,307, and a holed locating plate 323 and a pressure element in the form of a pressure plate 324. The locating plate 323 has tabs that are loosely constrained inside four-sided locating holes 325. The pressure plate 324 is fixedly attached to the locating plate with screws 326 and the pressure plate has tabs that are loosely constrained laterally by three-sided cut-outs 327 in the side plates 306,307, but the pressure plate is unconstrained in an outwardly direction, towards the horizontal protuberance 311. A pressure screw 328, which in the illustrated embodiment is an Alan cap screw, is screwed into a threaded hole in the fixed plate 321 and its free end is received inside the hole of the locating plate 323. The pressure screw 328 applies pressure to the pressure plate 324 when it is turned clockwise.

On the outside of the vertical protuberance 312, the pressure plate 324 of the horizontally expanding sub-assembly 314 provides a pressure-contact face or grip face that can press against the inside of the post cavity 305 when the pressure screw 320 is turned clockwise.

The loose constraint of the locating plate 323 in its locating holes 325 allows it to pivot between a receiving orientation and a grip orientation and the weight of the pressure plate 324 that is attached to one side of the locating plate causes the locating plate and pressure plate to pivot under gravity to the receiving orientation, when the vertical protuberance 312 is in an upright orientation outside the post cavity 304. By virtue of its attachment to the locating plate 323, the pressure plate 324 can also pivot between a receiving orientation and a grip orientation and when it is pivoted under gravity to the receiving orientation, the grip face protrudes from the vertical protuberance with a slanted orientation, as shown in FIGS. 49-50 and as described further below.

When the umbrella 100.3 is manufactured, the angle bracket 300 is assembled and the horizontal protuberance 311 is slid into the arm cavity 305 until an arm access aperture 330 lines up with the pressure screw 320. The pressure screw 320 is tightened, i.e. turned clockwise with an Alan key 331 in the direction shown in FIG. 43 and applies pressure on the pressure plate 318, which causes the pressure plate to press downwards against the inside of the arm cavity 305 and secures the angle bracket 300 to the cantilever arm. The angle bracket 300 is now ready to be attached to the post and this is typically done on site.

The upper edges of the side plates 306,307 are on opposing sides of the pressure plate 318 and as the pressure plate presses downwards, the upper edges of the side plates are pressed against the upper inside of the arm cavity 305, which ensures that the angle bracket 300 is correctly aligned relative to the cantilever arm 103. The angle bracket 300 is thus self-aligning and would align correctly without requiring fine manufacturing tolerances.

Figure 49:
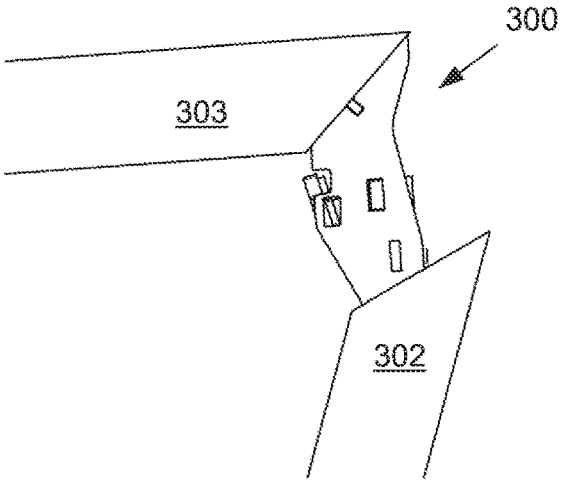
FIG. 49 is an elevation showing the cantilever arm and angle bracket of FIG. 40 being aligned with the vertical post during assembly.
Figure 50:
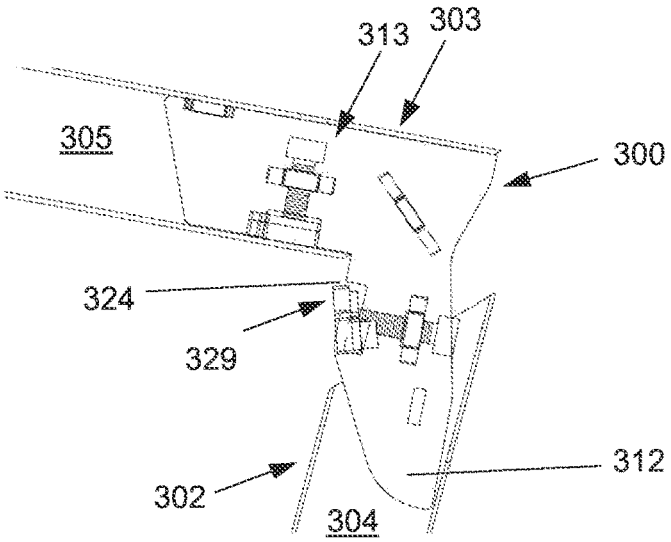
FIG. 50 is a cut-away elevation showing an outward-leaning alignment of a vertical pressure-plate of the angle bracket of FIG. 40 during assembly.

During further assembly (typically on site), the vertical protuberance 312 that now protrudes from the proximal end 303 of the cantilever arm 103, is positioned above the upper end 302 of the post 101 and a lower end of the vertical protuberance is placed just inside the post cavity 304, as shown in FIG. 49. At this stage, the pressure plate 324 has pivoted to its receiving orientation as described above, with the grip face 329 protruding from the vertical protuberance with a slanted orientation.

Figure 51:
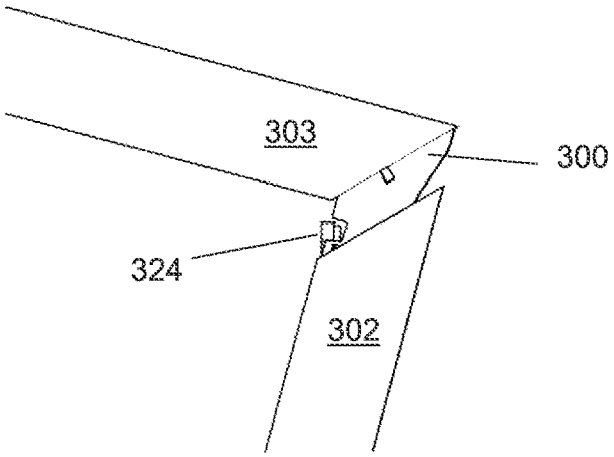
FIG. 51 is an elevation showing the cantilever arm being lifted and the angle bracket of FIG. 40 dropping into the vertical post during assembly.

As the vertical protuberance 312 is inserted deeper into the post cavity 304, as shown in FIGS. 50 and 51, the peripheral edge of the post cavity engages the slanted grip face 329 in a gentle wedge fashion and urges the pressure plate 324 to pivot inwards, to its grip orientation and allows the vertical protuberance to enter the post cavity completely without interference from the pressure plate 324.

In addition to pivoting of the pressure plate 324 by engagement with the peripheral edge of the post cavity 304, the angular orientation of the angle bracket 300 changes from when the end of the vertical protuberance 312 is first inserted into the post cavity (as shown in FIG. 49) until the distal end of the cantilever arm 103 is lifted and the vertical protuberance is fully inserted into the post cavity. This change in orientation of the angle bracket 300 assist with the pivoting action of the pressure plate 324 from its receiving orientation to its grip orientation, when it is inside the post cavity 304.

Figure 46:
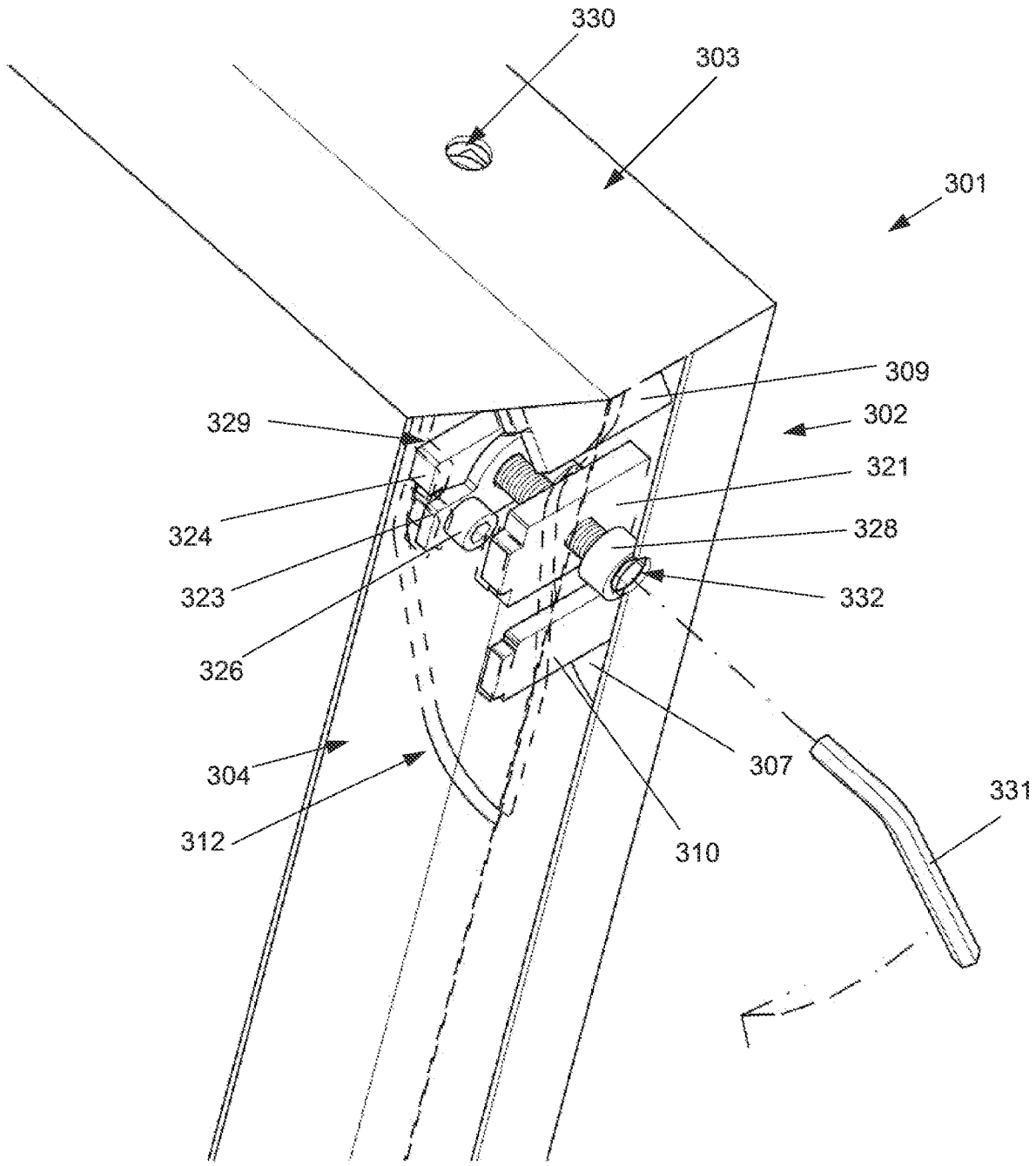
FIG. 46 is a three-dimensional view showing the position the angle bracket of FIG. 40 in the vertical post.
Figure 47:
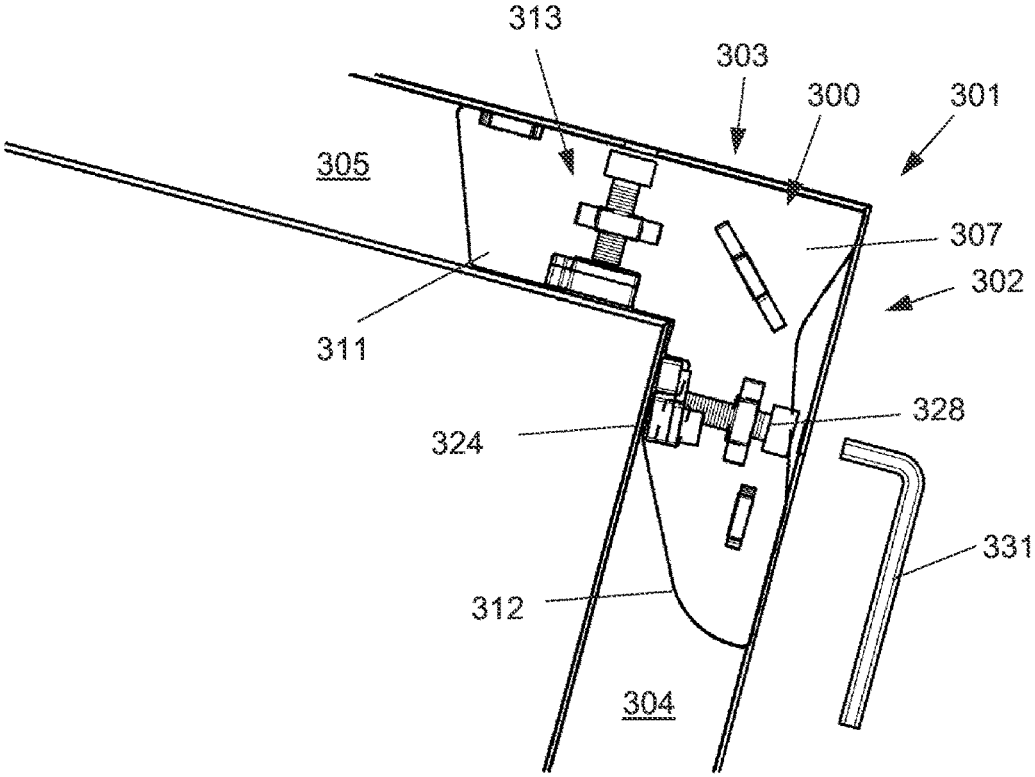
FIG. 47 is an elevation showing the angle bracket of FIG. 40 inserted into the vertical post with the pressure plate un-clamped.
Figure 48:
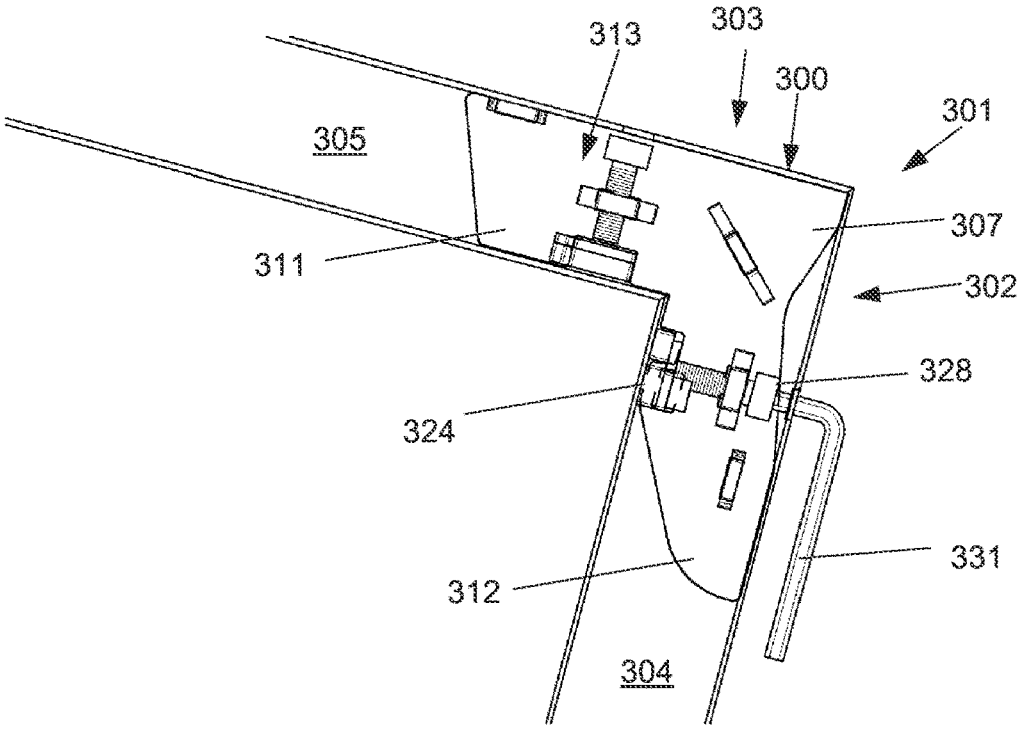
FIG. 48 is an elevation showing the angle bracket of FIG. 40 clamped into the vertical post, with the pressure plate clamped.

Once the vertical protuberance 312 is fully inserted into the post cavity 304, the pressure screw 328 lines up with a post access aperture 332 and the Alan key is inserted through the access aperture to turned the pressure screw clockwise in the direction shown in FIG. 46, to tighten the pressure screw and urge the pressure plate 324 outwards against the inside of the post cavity. The edges of the side plates 306,307 on the side of the vertical protuberance 312 that is opposite from the pressure plate 324, are pressed by the outward gripping action of the pressure plate, against the inside of the post cavity 304 in a triangulated fashion, to align the angle bracket 300 and thus the cantilever arm 103 with the post 101.

Referring to FIGS. 38 to 51, the umbrella 100.3 with its angle bracket 300 provides a greatly improved junction between the post 101 and cantilever arm 103, as follows:

It is neat and aesthetically attractive.

It is extremely rigid and structurally sound.

The self-alignment means that there is no need for tight manufacturing tolerances as the fit is loose prior to tightening and self-alignment.

It is quick and easy both during manufacture and assembly.

The invention claimed is:

1. An umbrella comprising:

a hub;

a plurality of radial arms extending from the hub;

a canopy;

an upright post;

a cantilever arm extending from the post to the hub with the canopy supported directly on top of the cantilever arm and radial arms;

wherein the hub is pivotally attached to the cantilever arm, to pivot about a pivot axis that is aligned with the cantilever arm;

wherein the umbrella is a radially opening umbrella and at least some of the radial arms are pivotally attached to the hub to pivot about upright axes along a conical plane of the canopy;

wherein the pivot axis and at least part of the cantilever arm are aligned with the conical plane of the canopy;

wherein the umbrella includes a latch mechanism that is displaceable between a free condition in which the hub is free to pivot about the pivot axis, and a latch condition in which the hub is held against pivoting about the pivot axis, said latch mechanism including a latch pin that is contained inside the cantilever arm and that is displaceable parallel to the pivot axis, to engage the hub; and wherein the umbrella includes a bar that is supported on the cantilever arm and that is manually operable from the proximity of the post to displace the bar along the cantilever arm to operate the latch mechanism between the free condition and the latch condition;

wherein said umbrella includes a lock mechanism including a stop formation that is supported on the cantilever arm in the proximity of the post, an end of the bar that faces towards the post being displaceable in the lock mechanism in a linear direction that is purely transverse to the pivot axis that is aligned with the cantilever arm, between a free position in which the bar can move longitudinally along the cantilever arm, and a lock position in which the end of the bar that faces towards the post buts against the stop formation so that the bar is prevented from longitudinal movement along the cantilever arm in a direction away from the hub, and the bar presses the latch pin towards the hub, and wherein the end of the bar that faces towards the post is biased in the direction transverse to the cantilever arm to the lock position, a default position.

2. The umbrella according to claim 1, wherein the radial arms extend radially outwards from the hub in a domed configuration, each of said radial arms having a distal end that is radially remote from the hub; and the canopy is supported in a domed configuration on top of the radial arms, said canopy being attached to at least some of the radial arms in the vicinity of the distal ends of said radial arms, and there being at least some tension in the canopy between the distal ends of at least some of the radial arms;

wherein at least some of the radial arms each comprises an inner part that is attached to the hub and an outer part that is pivotally attached to the inner part by a hinge mechanism, said hinge mechanism being configured to pivot the outer part between an un-activated position in which the outer part is aligned with the domed configuration of the canopy, and an activated position in which the distal end of the radial arm is pivoted towards the hub;

wherein each of said hinge mechanisms includes at least one stop formation that prevents the outer part of the radial arm from pivoting from its un-activated position in a direction away from its activated position; and wherein the tension in the canopy between distal ends of the radial arms resists pivoting motion of the outer parts of the radial arms towards their activated position, when they are in their un-activated positions.

3. The umbrella according to claim 2, wherein each hinge mechanism includes at least one inner stop formation that is attached to the inner part of the radial arm and at least one outer stop formation that is attached to the outer part of the radial arm, said inner stop formation and outer stop formation being held in abutment by the tension in the canopy, when the outer part of the radial arm is in its un-activated position.

4. The umbrella according to claim 1, wherein the upright post has a hollow upper end that defines an internal post cavity at least at the upper end and the cantilever arm has a hollow proximal end that is attached to the upper end of the post and said cantilever arm defining an internal arm cavity at least at the proximal end;

wherein umbrella includes a bracket with a horizontal protuberance that is receivable in the arm cavity, a vertically expanding sub-assembly that is supported on the horizontal protuberance and that is configured to be expanded to grip an inside of the arm cavity, a vertical protuberance that is receivable in the post cavity, and a horizontally expanding sub-assembly that is supported on the vertical protuberance and that is configured to be expanded to grip an inside of the post cavity.

5. The umbrella according to claim 4 wherein the horizontally expanding sub-assembly includes a pressure element that is loosely supported by the vertical protuberance to pivot between a receiving orientation and a grip orientation, said pressure element defining a grip face and being configured to pivot under gravity to the receiving orientation when the bracket is in an upright orientation at least partly outside the arm cavity, said grip face protruding from the vertical protuberance when the pressure element is in the receiving orientation and being disposed to engage with the inside of the arm cavity and to pivot the pressure element to the grip orientation when the vertical protuberance is inserted into the post cavity, said grip face being aligned with the inside of the arm cavity when the pressure element is in the grip orientation.

6. The umbrella according to claim 1, wherein the hub includes a plurality of locating holes and the latch pin is configured to engage the hub by way of a free end of the latch pin being received at least partly in a selected one of the plurality of locating holes, wherein the free end of the latch pin is tapered.

7. The umbrella according to claim 6, wherein the free end of the latch pin has a sharp conical shape with a vertex angle less than 90 degrees.

8. The umbrella according to claim 6, wherein the latch pin is attached to the bar with play, so that the latch pin can pivot relative to the bar.

9. The umbrella according to claim 6, or claim 7, or claim 8, wherein the bar is provided with a longitudinal spring that urges the bar and latch pin in a longitudinal direction towards the hub to provide a self-locating action that facilitates the tapered end of the latch to self-locate in a selected one of the locating holes on the hub.

10. The umbrella according to claim 1, or claim 2, or claim 3, or claim 6, or claim 7, or claim 8, wherein the latch mechanism includes a handle that is attached to the bar in the proximity of the post and is provided with a spring that urges the bar in the transverse direction to self-engage against the stop formation.

11. The umbrella according to claim 10, wherein the bar is provided with a longitudinal spring that urges the bar and latch pin in a longitudinal direction towards the hub to provide a self-locating action that facilitates the tapered end of the latch to self-locate in a selected one of the locating holes on the hub.

* * * * *